US006054666A

United States Patent [19]

Yamashita et al.

[11] Patent Number: 6,054,666

[45] Date of Patent: Apr. 25, 2000

[54] PAPER SHEET MATTER SORTING APPARATUS AND PAPER SHEET MATTER SORTING METHOD

[75] Inventors: Taichiro Yamashita; Yasunori Hamada, both of Tsuchiura; Takao Terayama, Ushiku; Nobuyoshi Sasaki, Yokohama; Toshihiko Tajiri, Aichi-gun, all of Japan

[73] Assignee: Hitachi, Ltd., Tokyo, Japan

[21] Appl. No.: 09/029,001

[22] PCT Filed: Aug. 30, 1995

[86] PCT No.: PCT/JP95/01724

§ 371 Date: Feb. 24, 1998

§ 102(e) Date: Feb. 24, 1998

[87] PCT Pub. No.: WO97/07902

PCT Pub. Date: Mar. 6, 1997

[51] Int. Cl.[7] ..... B07C 5/00

[52] U.S. Cl. ..... 209/583; 209/584; 209/900

[58] Field of Search ..... 209/584, 587, 209/583, 577, 576, 900

[56] References Cited

U.S. PATENT DOCUMENTS

| | | | |
|---|---|---|---|
| 5,119,954 | 6/1992 | Svyatsky et al. | 209/584 |
| 5,277,321 | 1/1994 | Nagasawa et al. | 209/583 |
| 5,363,967 | 11/1994 | Tilles et al. | 209/584 |
| 5,363,971 | 11/1994 | Weeks et al. | 209/584 |
| 5,433,325 | 7/1995 | Levaro et al. | 209/584 |
| 5,593,044 | 1/1997 | Yamashita et al. | 209/584 |

FOREIGN PATENT DOCUMENTS

| | | |
|---|---|---|
| 51-105897 | 9/1976 | Japan . |
| 55-9215 | 1/1980 | Japan . |
| 57-190684 | 11/1982 | Japan . |
| 58-159881 | 9/1983 | Japan . |
| 59-92085 | 5/1984 | Japan . |
| 63-104689 | 5/1988 | Japan . |

*Primary Examiner*—Donald P. Walsh
*Assistant Examiner*—Brett Martin
*Attorney, Agent, or Firm*—Antonelli, Terry, Stout & Kraus, LLP

[57] ABSTRACT

A letter sorting apparatus which can perform the sorting for each letter carrier and a delivery sequence organization sorting work in accordance with bar codes. The apparatus includes a first accumulating arrangement provided above and adjacent to a supplying section and having a letter returning mechanism, and second accumulating arrangement of a fixed type provided above and adjacent to the first accumulating means. The sorting for each letter carrier by use of the first accumulating arrangement and the second accumulating arrangement is effected. Further, the delivery sequence sorting can be performed in such a manner that letters accumulated in the first accumulating arrangement are returned to the supplying section to repeat the sorting.

8 Claims, 16 Drawing Sheets

SORTING INFORMATION : 00-00~31-31(BY 32-ARY NUMBER)

PAPER SHEET MATTER SORTING APPARATUS AND PAPER SHEET MATTER SORTING METHOD

TECHNICAL FIELD

The present invention relates to a paper sheet matter sorting apparatus which reads sorting information such as bar codes provided on paper sheet matters such as postal matters to sort the loaded paper sheet matters in accordance with the sorting information, and more particularly to a paper sheet matter sorting apparatus which enables the delivery sequence organization of postal matters for rearrangement in a delivery sequence according to the addresses of destinations of the postal matters.

BACKGROUND ART

The conventional apparatus reading sorting information provided on paper sheet matters such as postal matters to rearrange the loaded paper sheet matters in a sequence designated by the sorting information includes, for example, a paper sheet matter supplying/retrieving apparatus disclosed by JP-A-51-105897.

In this prior art, an accumulating section is provided in the vicinity of a supplying section, for example, just above the supplying section and the sorting is repeated by opening the bottom surface of the accumulating section to drop and transfer the accumulated paper sheet matters into the supplying section, so that the loaded paper sheet matters can be rearranged in a sequence designated by sorting information.

In the above-mentioned prior art, the amount of letters capable of being subjected to delivery sequence organization sorting is limited to an amount by which they can be accumulated in the accumulating section at once. For example, provided that the amount of handled letters with an average thickness of 1 mm per sheet is 2000 sheets, the total thickness of letters comes to 2 m.

In the supplying means, paper sheet matters can be supplied close together. Therefore, at least 2 m suffices for the length of the supplying means.

In many cases, the amounts of letters accumulated in the respective accumulating units are not equal since the amount is different depending upon designation addresses. Also, each accumulating unit needs any margin space for the thickness of letters which can be accumulated. For example, in order to accumulate letters up to the thickness of 80 mm, an accumulating unit needs a space of about 120 mm, that is, 1.5 times as large as the accumulation thickness. Accordingly, in order that letters corresponding to 2 m are accumulated uniformly or equally, the whole of accumulating units needs a space of 3 m in total.

Further, provided that letters are not accumulated equally, the accumulating section or the whole of accumulating units needs a space added with a proper margin or a space of, for example, 4 m, that is, two times as large as the length of the supplying section. Namely, there is a problem that a sorter provided with such an accumulating section has a large size in which the width is about 5 m.

DISCLOSURE OF THE INVENTION

An object of the present invention is to provide a small-size paper sheet matter sorting apparatus which can perform a delivery sequence organizing work for sorted postal matters.

To attain the above object, a paper sheet matter sorting apparatus is characterized by comprising supplying means for supplying a plurality of paper sheet matters having sorting information thereon denoted beforehand, separating means for successively separating and taking out the paper sheet matters supplied by the supplying means, reading means for reading the sorting information from the paper sheet matters taken out by the separating means, first accumulating means disposed above and adjacent to the supplying means and having a plurality of accumulating units for accumulating the paper sheet matters on the basis of the result of reading by the reading means, second accumulating means disposed above and adjacent to the first accumulating means and having a plurality of accumulating units for accumulating the paper sheet matters on the basis of the result of reading by the reading means, and conveying means by which the paper sheet matters subjected to the reading of the sorting information by the reading means are conveyed to the first accumulating means or the second accumulating means.

In the present invention, the following embodiments are effective.

(1) The first accumulating means includes letter transferring means by which the paper sheet matters accumulated in the plurality of accumulating units of the first accumulating means are transferred to the supplying means with the sequence of the paper sheet matters being not changed.

(2) The first accumulating means and the second accumulating means accumulate the paper sheet matters in an approximately standing posture.

(3) The supplying means, the first accumulating means and the second accumulating means have their widths which are approximately equal to each other.

(4) The first accumulating means is positioned between the supplying means and the second accumulating means.

(5) In the embodiment of (1), the paper sheet matters are rearranged in a predetermined sequence in accordance with the sorting information by accumulating the paper sheet matters supplied to the supplying means into the plurality of accumulating units of the first accumulating means in a sorted manner in accordance with the sorting information denoted on the paper sheet matters, thereafter transferring the paper sheet matters to the supplying means by the letter transferring means with the sequence of the paper sheet matters being not changed, and thereafter repeating a sorting operation of accumulating the paper sheet matters again into the plurality of accumulating units of the first accumulating means in a sorted manner in accordance with the sorting information denoted on the paper sheet matters.

(6) Each of the first accumulating means and the second accumulating means includes a reject accumulating unit of a large capacity for accumulating paper sheet matters which are rejected.

(7) In the embodiment of (5), when the paper sheet matters supplied to the supplying means are accumulated into the plurality of accumulating units of the first accumulating means in a sorted manner in accordance with the sorting information denoted on the paper sheet matters, only paper sheet matters having at least one kinds of specified sorting information denoted thereon are accumulated into the accumulating units of the second accumulating means.

(8) In the embodiment of (6), one of the reject accumulating units accumulates only paper sheet matters having specified sorting information denoted thereon.

(9) In the embodiment of (1), the paper sheet matter supplied to the supplying means is accumulated into the first accumulating means in a sorted manner in the case where the sorting information denoted on the paper sheet matter belongs to a sequence earlier than predetermined sorting information and into the second accumulating means in a sorted manner in the case where it belongs to a sequence later than the predetermined sorting information, the paper sheet matters accumulated into the first accumulating means in a sorted manner are rearranged in a predetermined sequence in accordance with the sorting information by transferring the paper sheet matters to the supplying means by the letter transferring means with the sequence of the paper sheet matters being not changed and thereafter repeating a sorting operation of accumulating the paper sheet matters again into the plurality of accumulating units of the first accumulating means in a sorted manner in accordance with the sorting information denoted on the paper sheet matters, and the paper sheet matters accumulated into the second accumulating means in a sorted manner are thereafter rearranged in a predetermined sequence in accordance with the sorting information by transferring the paper sheet matters to said supplying means by the letter transferring means with the sequence of the paper sheet matters being not changed and thereafter repeating a sorting operation of accumulating the paper sheet matters into the first accumulating means in a sorted manner in accordance with the sorting information denoted on the paper sheet matters.

(10) In the embodiment of (5), when the paper sheet matters supplied to the supplying means are accumulated in a sorted manner on the basis of the sorting information on the paper sheet matters for every paper sheet matters concerned with the same delivery distinct, first paper sheet matters with the sorting information thereof belonging to a sequence earlier than predetermined sorting information belonging to the delivery distinct and second paper sheet matters with the sorting information thereof belonging to a sequence later than the predetermined sorting information are accumulated into separate accumulating units in a sorted manner, only the first paper sheet matters are thereafter supplied to the supplying means and rearranged in a predetermined sequence in accordance with the sorting information denoted on the paper sheet matters, and only the second paper sheet matters are thereafter supplied to the supplying means and rearranged in a predetermined sequence in accordance with the sorting information denoted on the paper sheet matters.

Also, to attain the above object, a paper sheet matter sorting apparatus according to the present invention is effective when it is characterized by the following construction. Namely, in a paper sheet matter sorting apparatus comprising supplying means for supplying a plurality of paper sheet matters having sorting information thereon denoted beforehand, separating means for successively separating and taking out the paper sheet matters supplied by the supplying means, reading means for reading the sorting information from the paper sheet matters taken out by the separating means, first accumulating means disposed above and adjacent to the supplying means and having a plurality of accumulating units for accumulating the paper sheet matters on the basis of the result of reading by the reading means, second accumulating means disposed above and adjacent to the first accumulating means and having a plurality of accumulating units for accumulating the paper sheet matters on the basis of the result of reading by the reading means, and conveying means by which the paper sheet matters subjected to the reading of the sorting information by the reading means are conveyed to the first accumulating means or the second accumulating means, the second accumulating means and the second distributing means are detachable units.

Further, a paper sheet matter sorting method according to the present invention is characterized in that paper sheet matters posted and collected in the territory of a terminal office for performing the collection of paper sheet matters in the territory and the delivery to destinations in the territory and including the mixture of destination addresses are sorted by the terminal office beforehand on the basis of the sorting information provided on the paper sheet matters so that they are sorted into paper sheet matters addressed to destinations in the territory of the terminal office, paper sheet matters addressed to destinations in the territory of an area sorting office which is provided in each area and by which paper sheet matters in that area are collected and paper sheet matters addressed to other areas are sent to those areas, paper sheet matters addressed to destinations in the territory of a relay office which is provided by at least one in number and relays the transportation of paper sheet matters between the area sorting office and the terminal office, and paper sheet matters addressed to areas other than an area to which the terminal office belongs, and paper sheet matters other than the paper sheet matters addressed to destinations in the territory of the terminal office are transported to the relay office.

If the first accumulating section and the second accumulating section are disposed above the supplying means and the dimension of each of the supplying means, the first accumulating section and the second accumulating section is about 2 m, 2000 letters having the average thickness of 1 mm per letter can be accumulated in a sorted manner and such a sorter is small in size as about 3 m in dimension.

According to the present invention, paper sheet matters having sorting information indicated thereon, for example, postal matters can be rearranged in a sequence designated by the sorting information, thereby making it possible to improve the efficiency of a delivery sequence organizing work. Further, since each of the supplying section and the accumulating section is placed in an extent of about 2 m in width, a slight movement of a worker is enough to reach the supplying section and the accumulating section. Therefore, a load imposed on the worker is reduced, thereby making it possible to improve the working environment.

BEST MODE FOR CARRYING OUT THE INVENTION

Now, embodiments of the present invention will be described on the basis of the drawings.

Figure 1:
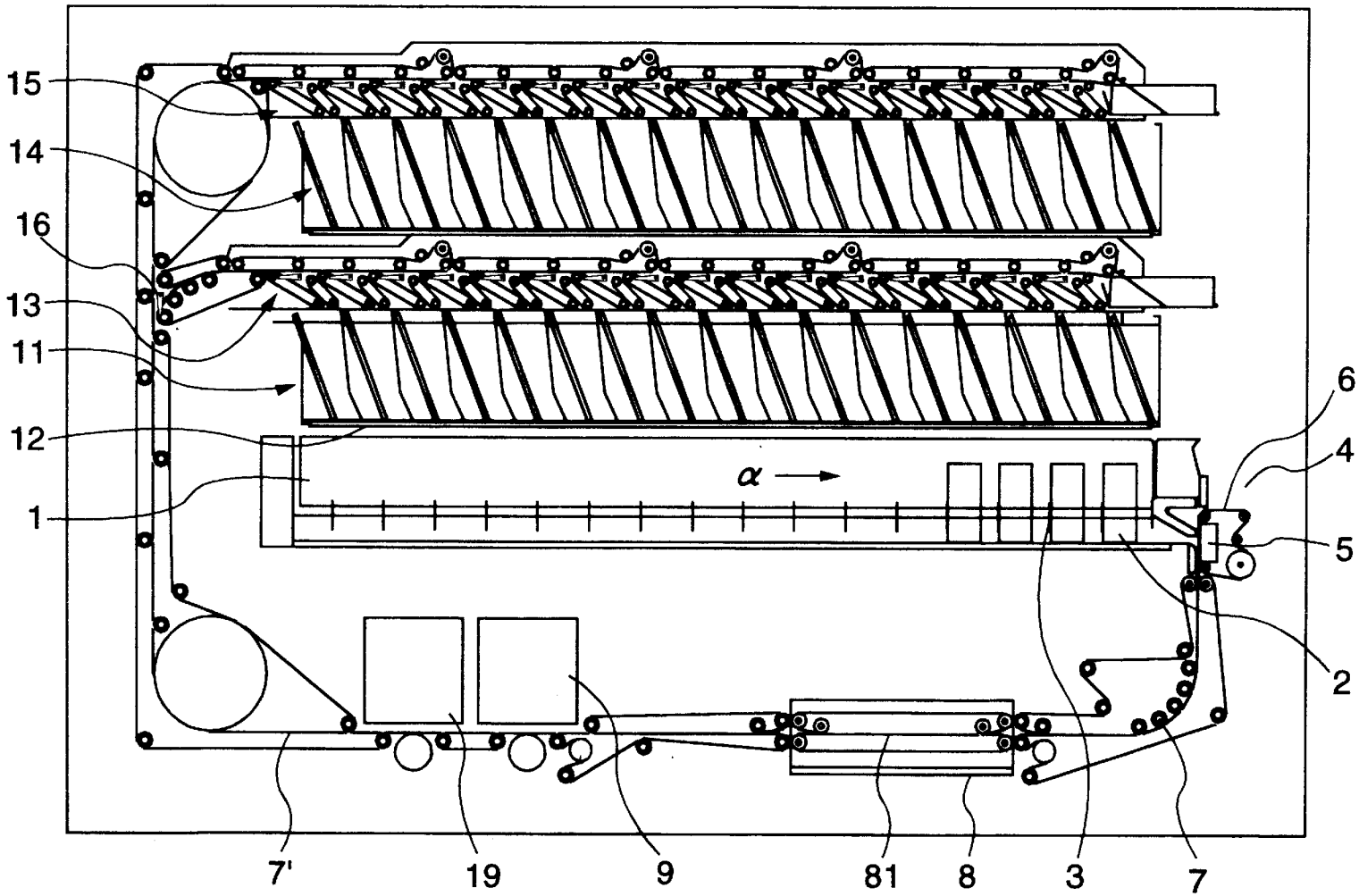
FIG. 1 is a front view showing an embodiment of a paper sheet matter sorting apparatus of the present invention.

FIG. 1 is a view showing the construction of an embodiment of an apparatus according to the present invention. In FIG. 1, numeral 1 denotes supplying means capable of holding a plurality of paper sheet matters 2 in a standing posture, and numeral 3 denotes transporting means supported at equal intervals along the supplying means 1 and movably in a direction of arrow α. The transporting means 3 can move the paper sheet matters 2 in the direction of arrow α while pushing the paper sheet matters 2.

Numeral 4 denotes separating means capable of separating only one of the paper sheet matters 2 placed on the supplying means 1 at the right end thereof to convey it downward. Generally, such paper sheet matter separating means has a suction system using a vacuum suction belt. In this suction system, a vacuum chamber 5 is applied with a negative pressure to absorb the paper sheet matters 2 to a suction belt 6 and the suction belt 6 is rotated by use of driving means such as an electric motor, so that only one of the paper sheet matters 2 at the right end thereof can be separated and conveyed.

Numeral 7 denotes conveying means capable of conveying the paper sheet matters 2. In the conveying means 7, the paper sheet matter 2 separated by the separating means 4 is conveyed, for example, with opposite surfaces thereof sandwiched between belts.

Numeral 8 denotes posture correcting means capable of correcting the position and inclination of the letter 2, for example, by pushing the side face of the letter 2 against a member provided parallel to the conveying means 7 by use of an inclination belt 81 inclined relative to the conveying means 7.

Numeral 9 denotes character reading means for reading sorting information such as a bar code which is applied on the paper sheet matter 2 beforehand.

Numeral 19 denotes character reading means for reading sorting information such as a postal code (or ZIP code) which is applied on the paper sheet matter 2 beforehand.

Numeral 11 denotes first accumulating means for accumulating therein the paper sheet matters 2 having been subjected to the reading of sorting information. The first accumulating means 11 is disposed above and in proximity to the supplying means 1. The interior of the first accumulating means 11 is divided into a plurality of (for example, sixteen) accumulating units each of which is constructed so that it can accumulate the paper sheet matters 2 in an approximately standing posture. It is constructed such that intervals between the accumulating units are equal to intervals between the transporting means 3.

Numeral 12 denotes a bottom plate of the accumulating means 11. The bottom plate 12 is supported so that it can be moved freely in a depth direction. It is constructed such that by moving the moving bottom plate 12 in the depth direction, the paper sheet matters 2 accumulated in the first accumulating means 11 can be transferred to the supplying means 1 in a sequence as accumulated. Since the intervals between the accumulating units are equal to the intervals between the transferring means 3, the paper sheet matters 2 accumulated in the accumulating unit can be dropped and transferred between the transporting means 3.

Numeral 13 denotes first distributing means for distributively loading the paper sheet matter 2 into one of the accumulating units of the accumulating means 11 in accordance with sorting information read by the reading means 9.

Numeral 14 denotes second accumulating means for accumulating therein the paper sheet matters 2 having been subjected to the reading of sorting information. The second accumulating means 14 is disposed above and in proximity to the first accumulating means 11. The interior of the second accumulating means 14 is divided into a plurality of (for example, sixteen) accumulating units each of which is constructed so that it can accumulate the paper sheet matters 2 in an approximately standing posture.

Numeral 15 denotes second distributing means for distributively loading the paper sheet matter 2 into one of the accumulating units of the accumulating means 14 in accordance with sorting information read by the reading means 9 or the reading means 19.

Numeral 16 denotes gate means placed in the course of conveying means 7' for conveying the paper sheet matters 2 having been subjected to the reading of sorting information 20. The gate means 16 distributes the destination of the paper sheet matters 2 for accumulation into either the first accumulating means 11 or the second accumulating means 14.

Figure 2:
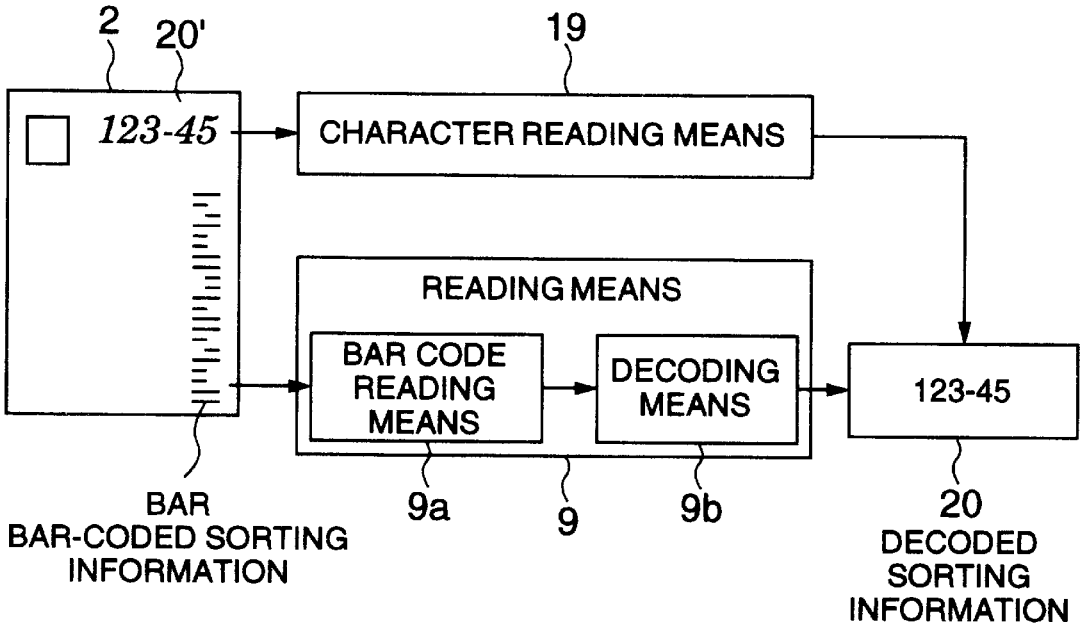
FIG. 2 is a diagram showing an example of sorting information and reading means which form the paper sheet matter sorting apparatus of the present invention.

FIG. 2 is a diagram showing an example of the construction of the sorting information, the reading means 9 and the character reading means 19 which constitute the present invention. The sorting information is applied onto a paper sheet matter beforehand. In FIG. 2, numeral 9*a* denotes bar code reading means which is provided in the reading means 9 and can read a bar code BAR representing numerals or characters, for example, by virtue of the length of a bar, numeral 9*b* denotes decoding means by which the bar code BAR read by the bar code reading means 9*a* can be decoded into the original numerals or characters, and numeral 15 denotes decoded sorting information represented by the original numerals or characters.

The character reading means 19 can read sorting information 20' composed of hand-written or printed characters or numerals.

Figure 3:
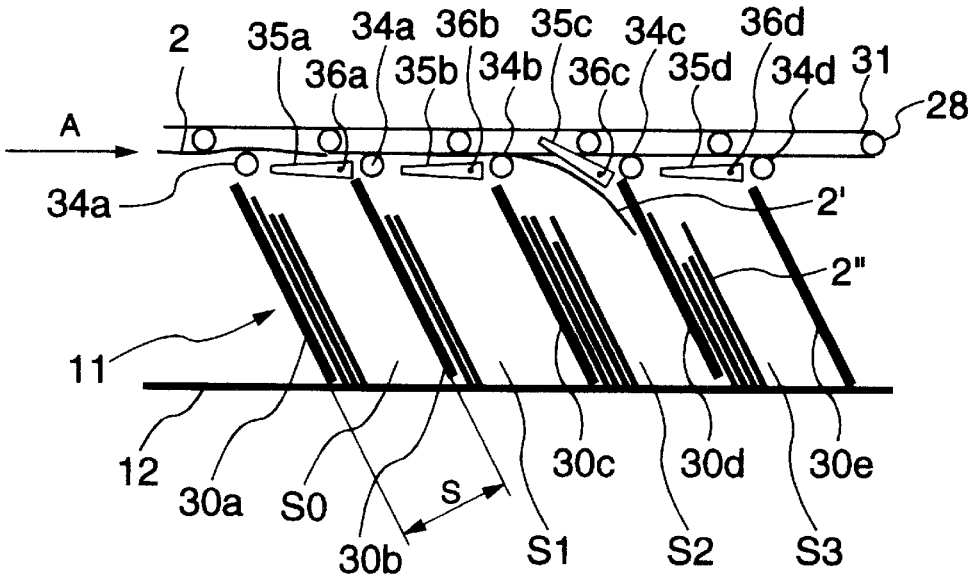
FIG. 3 is a front view showing an example of accumulating means and distributing means which form the paper sheet matter sorting apparatus of the present invention.

FIG. 3 is a front view showing an example of the construction of the first accumulating means 11 and the first distributing means 13 which constitute the present invention. In FIG. 3, numerals 30*a*, 30*b*, 30*c*, - - - denote partitions for dividing the first accumulating means 11 into accumulating units S1, S2, S3, - - - . Numeral 31 denotes a belt for conveying the paper sheet matters 2. The belt 31 forms a part of the conveying means 7 and moves in a direction indicated by arrow A.

Numeral 35 denotes a switching gate by which the paper sheet matter 2 conveyed from the direction of arrow A while being sandwiched between the belt 31 and a roller 34 is distributively loaded into the predetermined accumulating unit Si, S2, S3, - - - . The switching gate 35 can be rotated by a predetermined angle around a rotation center 36. The switching gates 35 are arranged on opposite sides of the belt 31 in its width direction. Alternatively, in the case where the belt 31 includes a plurality of belts arranged parallel to each other in the width direction with gaps provided therebetween, the switching gate 35 is arranged in the gap between the belts 31. The switching gate 35 and the belt 31 have a positional relation with which the switching gate 35 does not contact the belt 31 even when the switching gate 35 is rotated.

For example, when the switching gate 35 is positioned approximately parallel to the belt 31, as shown by 35*a* or 35*b*, the paper sheet matter 2 is passed between the switching gates 35*a* and 35*b* and the belt 31 so that it is conveyed up to the switching gate 35*c*. Now, if the switching gate 35*c* is rotated by the predetermined angle around the rotation center 36*c* so that the tip of the switching gate 35*c* is positioned on the pulley 28 side with respect to the belt 31, the paper sheet matter 2 is passed on the first accumulating means 11 side of the switching gate 35*c*, as shown by 2', so that it is loaded into the accumulating unit S3. By providing such constructions consecutively in a longitudinal direction of the first accumulating means 11 at intervals S by the number of required accumulating units, the first accumulating means 11 can be divided into, for example, sixteen accumulating units. Paper sheet matters 2" loaded into the respective accumulating units S1 to S16 in a sorted manner stand in a line along the partition 30 of each accumulating unit so that they are accumulated in an inclined but approximately standing posture.

Figure 4:
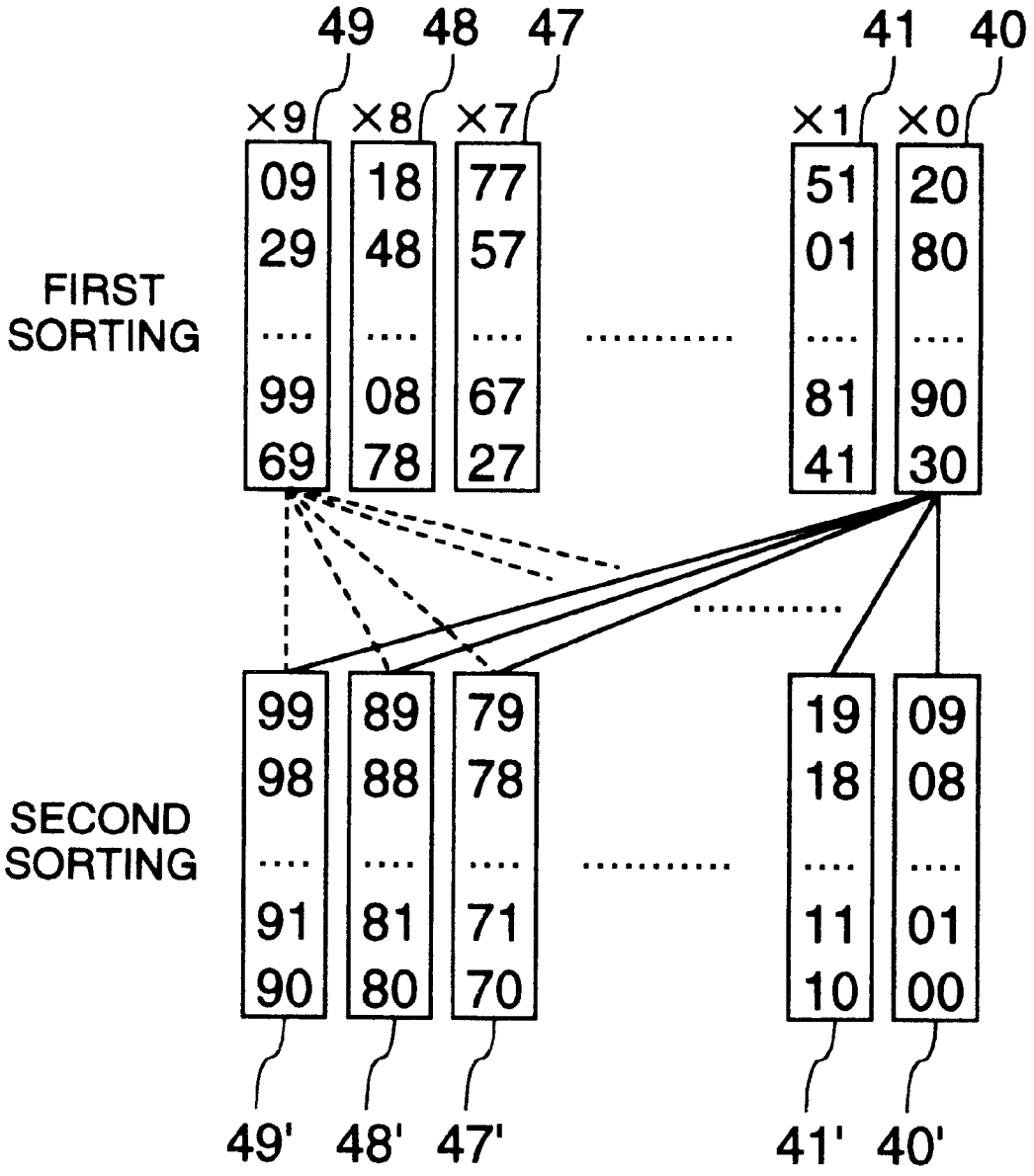
FIG. 4 is an explanatory diagram showing an example of a paper sheet matter rearranging operation.

Next, description will be made of the process of an operation for rearrangement of paper sheet matters 2 (or a delivery sequence organizing operation) according to the present invention. FIG. 4 is a schematic diagram showing an example of the delivery sequence organizing operation for paper sheet matters 2 in the paper sheet matter sorting apparatus.

For the convenience of description, it is assumed that the contents of the sorting information 20 are represented by two-figure numerals from 00 to 99. Now, 100 sheets of paper sheet matters 2 applied with sorting information 20 of 00 to 99 irregularly arranged will be subjected to an operation for rearrangement in a sequence designated by the sorting information 20 (or a delivery sequence organizing operation). Herein, only the arrangement of sorting information 20 in the process of rearrangement of paper sheet matters 2 will be described without mentioning the operation of each constituent element in detail.

In FIG. 4, it is assumed that blocks 40, 41, - - - , 48, 49 correspond to ten accumulating units of the first accumulating means 11. The respective accumulating units are associated with numerals of 0 to 9. Conveyed paper sheet matters 2 will be loaded into the accumulating units in a sorted manner in accordance with the sorting information 20.

In a first sorting, the accumulating units 40, 41, 42, - - - , 49 are sequentially assigned with digits 0 to 9 in the 1st order (or the order of 1) of the sorting information. Next, the supplied paper sheet matters 2 are taken out one by one in a separated manner and the taken paper sheet matter is distributively loaded into one of the accumulating units 40, 41, 42, - - - , 49 in accordance with the 1st order of the sorting information.

Thereby, paper sheet matters 2 having the same 1st-order digit in the sorting information are accumulated in each of the accumulating units 40, 41, 42, - - - , 49. In this state, the 2nd-order digits are not arranged in sequence.

In a second sorting, the accumulating units 40, 41, 42, - - - , 49 are sequentially assigned with digits 0 to 9 in the 2nd order (or the order of 10) of the sorting information. Now, the paper sheet matters 2 completed for the first sorting will be taken out together with the sequence being not changed, so that they are taken out one by one in a separated manner in sequence from paper sheet matters 2 having been accumulated in the accumulating unit 40 and the taken paper sheet matter is distributively loaded into one of accumulating units 40', 41', 42', - - - , 49' in accordance with the 2nd order of the sorting information.

First, only paper sheet matters 2 taken out of the accumulating unit 40 having the 1st-order digit of 0 are distributively loaded into the accumulating units 40', 41', 42', - - - , 49' in accordance with the 2nd order. Next, paper sheet matters 2 taken out of the accumulating unit 41 having the 1st-order digit of 1 are distributively loaded into the accumulating units 40', 41', 42', - - - , 49' in accordance with the 2nd order so that the loaded paper sheet matter 2 is stacked on the paper sheet matter 2 having the 1st-order digit of 1. Similarly, paper sheet matters 2 having the 1st-order digits of 2 to 9 are separated and taken out in sequence so that they are distributively loaded into the accumulating units 40' to 49' in accordance with the 2nd order. When the sorting of all the paper sheet matters 2 is completed, the accumulating unit 40' has paper sheet matters 2 with sorting information of 00 to 09 accumulated in sequence and the accumulating unit 49' has paper sheet matters 2 with sorting information of 90 to 99 accumulated in sequence.

Now, if all of the paper sheet matters 2 accumulated in the accumulating units 40' to 49' are taken out in sequence, there is obtained a state in which all the paper sheet matters are rearranged in a sequence from 00 to 99 in sorting information.

Though the above description has been made in conjunction with an example in which the operation for 100 ways of rearrangement into the sequence from 00 to 99 is performed in such a manner that the sorting into 10 accumulating units is repeated two times, such an operation is not limited to this example. Provided that the number of accumulating units is U and the number of times of repetition is n, $U^n$ ways of rearrangement are possible. For example, provided that U=10 and n=3, 1000 ways of rearrangement are possible.

Also, the rearrangement of paper sheet matters 2 has resulted in that the left end is the sorting information of 99 and the right end is the sorting information of 00. However, if the arrangement of numerals to be associated with the accumulating units 40 to 49 is reversed, it is possible to rearrange the paper sheet matters 2 so that the right end is the sorting information of 00 and the left end is the sorting information of 99.

The above-mentioned procedure for rearrangement can be realized by providing means by which paper sheet matters sorted once into the accumulating units are transferred to the supplying section 1 with the sequence being not changed and disposing the separating means 4 at the right end of the supplying section 1.

In the case where the rearrangement is to be made, it is necessary to repeat the sorting plural times, as described above. Also, paper sheet matters 2 to be processed can be neither changed in sequence nor newly added in number in the course of rearrangement. Therefore, the amount of paper sheet matters 2 to be processed is limited to an amount by which they can be supplied to the supplying means 1 at once and can be accumulated in the accumulating means at once. According to the present embodiment, the reduction in size of the apparatus can be realized while satisfying such a condition, as will be described in the following.

Now, provided that the average thickness of a paper sheet matter 2 is 1 mm and the amount of paper sheet matters 2 to be processed at once is 2000 sheets, the required length of the supplying means 1 amounts to at least 2 m when all of the paper sheet matters 2 are supplied close together to the supplying means 1.

When the 2000 sheets of paper sheet matters 2 are sorted in such a manner that they are distributed into either the first accumulating means 11 or the second accumulating means 14 in accordance with respective destination addresses, the amounts of paper sheet matters accumulated in the respective accumulating units are not equal since the amount is different depending upon the destination address. Further, each accumulating unit needs any margin space in order that the paper sheet matters 2 are accumulated without causing a paper jam. For example, in order to accumulate the letters up to the thickness of 80 mm, an accumulating unit needs a space of about 120 mm, that is, 1.5 times as large as the accumulation thickness. Accordingly, in order that letters corresponding to 2 m are accumulated uniformly or equally, the whole of accumulating units needs a space of at least 3 m in total.

Further, since paper sheet matters 2 are not accumulated equally, as described earlier, there may be, for example, the case where a certain accumulating unit is full whereas another accumulating unit has a little amount of accumulated paper sheet matters. Accordingly, unless the accumulating capacity of the whole of accumulating units is made larger than 3 m, the accumulating units cannot accumulate all of paper sheet matters 2 supplied to the supplying means 1. Paper sheet matters 2 having failed in accumulation are rejected so that they are accumulated into a reject accumulating unit. Since those paper sheet matters must be processed separately after the completion of a series of sorting processes, the efficiency of a sorting work is deteriorated. In order to reduce the number of paper sheet matters 2 which are to be rejected, it is necessary to let the accumulating capacity of the whole of accumulating units have a margin, thereby preventing any accumulating unit from becoming full. Taking such a margin into consideration, the whole of accumulating units needs a space of 4 m, that is, two times as large as the length of the supplying section. If such accumulating units are provided in a row, a sorter amounts to about 5 m in width or becomes large in size.

If the accumulating section is divided into a plurality of stages, it is possible to reduce the width of the accumulating section. In the case of two stages, the width of 2 m suffices. In the case of four stages, the width of 1 m suffices. However, a distributing convey path is required for distributing the conveyed paper sheet matters 2 into the respective stages and the width of the distributing convey path needs about 50 cm.

If the supplying means 1 and accumulating means are arranged broadwise, the width of the whole of a sorter amounts to the sum of the width of the supplying means 1 and the width of the accumulating means. When the accumulating means is divided into two stages, the width of the sorter amounts to about 5 m. When the accumulating section is divided into four stages, the width of the sorter amounts to about 4 m. Though the width of the sorter becomes small when the accumulating section is divided into four or more stages, the structure of the distributing convey path becomes complicated as the number of stages becomes large.

If the accumulating section is divided into two stages, the length thereof comes to 2 m which is approximately the same as the length of the supplying means 1. Then, if two-stage accumulating means is provided above and adjacent to the supplying means 1, each of the supplying means and the accumulating means can accommodate about 2000 sheets of paper sheet matters 2 and the width of a sorter can be made small as about 3 m.

Further, since the supplying means 1 and the accumulating means are placed in an extent of about 2 m in width, a slight movement of a worker is enough to reach the supplying means 1 and the accumulating means. Therefore, a load imposed on the worker is reduced, thereby making it possible to improve the working environment.

Figure 5:
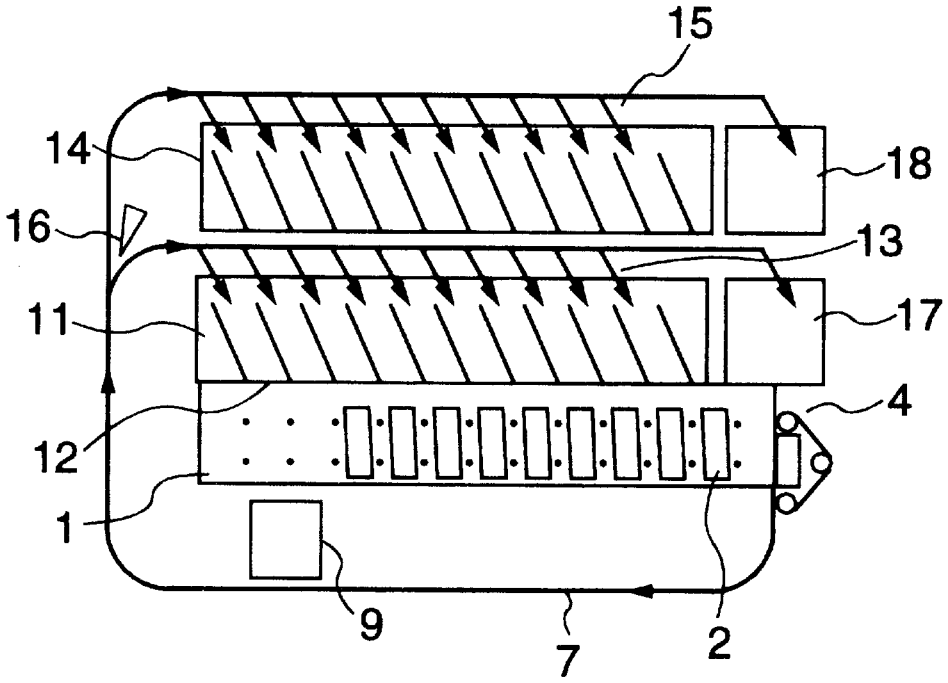
FIG. 5 is a front view showing an embodiment of the paper sheet matter sorting apparatus of the present invention in a simplified form.

Next, an example of the construction of the paper sheet distributing apparatus according to the present invention will be described referring to FIGS. 5, 6 and 7. FIG. 5 is a schematically simplified representation of the paper sheet matter sorting apparatus shown in FIG. 1. A conveying path of paper sheet matters 2 is simply indicated by solid line. In the shown example, it is assumed that the number of accumulating units in each of the first accumulating means 11 and the second accumulating means 14 is 11.

In a manner similar to that shown in FIG. 1, paper sheet matters 2 supplied to the supplying means 1 are conveyed by conveying means 7 in a form separated downward one by one by separating means 4 and sorting information such as a bar code denoted beforehand on the paper sheet matter 2 is read by reading means 9 (see FIG. 5). The paper sheet matters 2 subjected to the reading of sorting information are conveyed upward by the conveying means 7 at the greatest distance from the separating means 4 and are distributed by gate means 16. Thereafter, the paper sheet matters 2 are conveyed in a direction getting near the separating means 4 and are accumulated by either first distributing means 13 or second distributing means 15 into accumulating units of the first accumulating means 11 or the second accumulating means 14 in a sorted manner. Numerals 17 and 18 denote reject accumulating means for accumulating paper sheet matters 2 accumulated into neither the first accumulating means 11 nor the second accumulating means 14.

Figure 6:
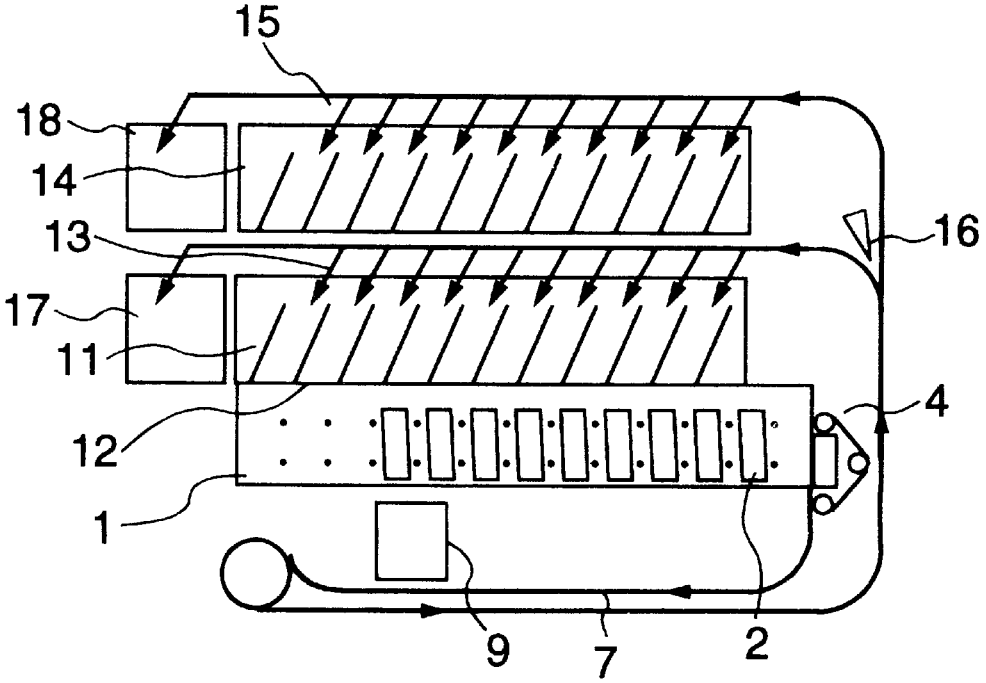
FIG. 6 is a front view showing another embodiment of the paper sheet matter sorting apparatus of the present invention in a simplified form.

FIG. 6 shows another embodiment. Namely, paper sheet matters 2 supplied to the supplying means 1 are conveyed by conveying means 7 in a form separated downward one by one by separating means 4 and sorting information such as a bar code denoted beforehand on the paper sheet matter 2 is read by reading means 9. The progressing direction of the paper sheet matters 2 subjected to the reading of sorting information is changed to a direction approaching the separating means 4. The paper sheet matters 2 are conveyed upward in the vicinity of the separating means 4 and are distributed by gate means 16. Thereafter, the paper sheet matters 2 are conveyed in a direction receding from the separating means 4 and are accumulated by either first distributing means 13 or second distributing means 15 into accumulating units of the first accumulating means 11 or the second accumulating means 14 in a sorted manner. Numerals 17 and 18 denote reject accumulating means for accumulating paper sheet matters 2 accumulated into neither the first accumulating means 11 nor the second accumulating means 14.

Figure 7:
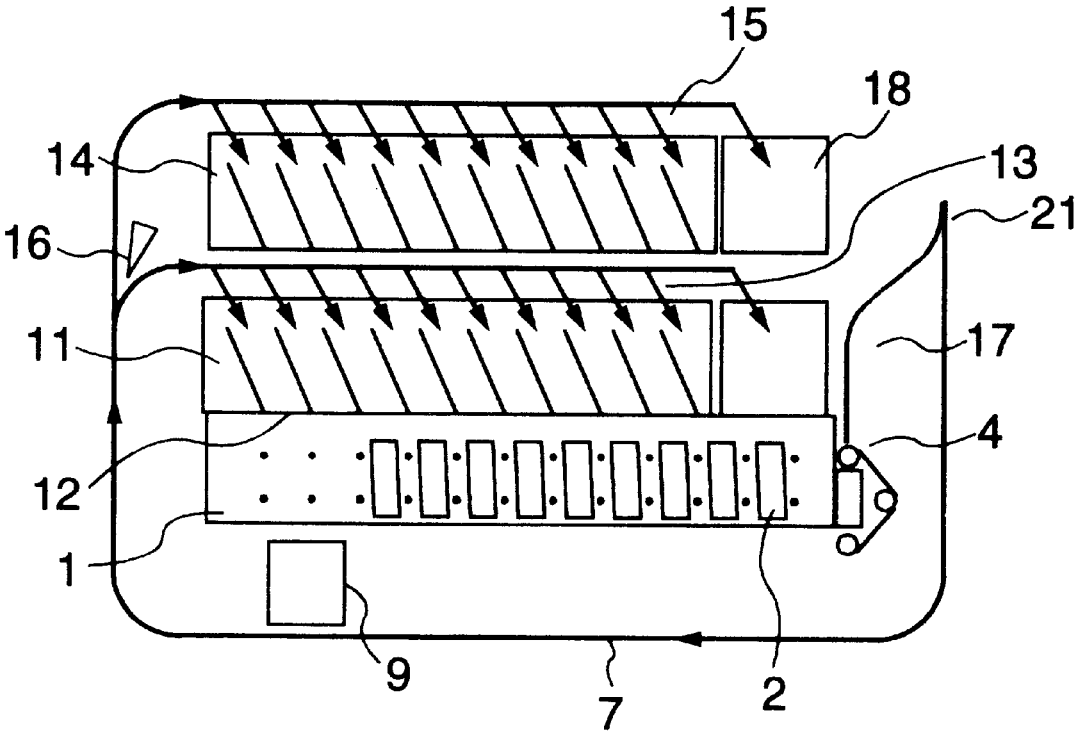
FIG. 7 is a front view showing a further embodiment of the paper sheet matter sorting apparatus of the present invention in a simplified form.

FIG. 7 shows a further embodiment. The present embodiment is different from the embodiment of FIG. 5 in that the direction of separation of paper sheet matters 2 by separating means 4 is not downward but upward and that inverting means 21 for inverting the progressing direction of the paper sheet matters 2 is provided. The inverting means 21 is provided in order to prevent the upper and lower sides of the paper sheet matter 2 from being inverting between a state in which the paper sheet matter 2 is supplied into the supplying means 1 and a state in which it is accumulated into the accumulating means.

Figure 8:
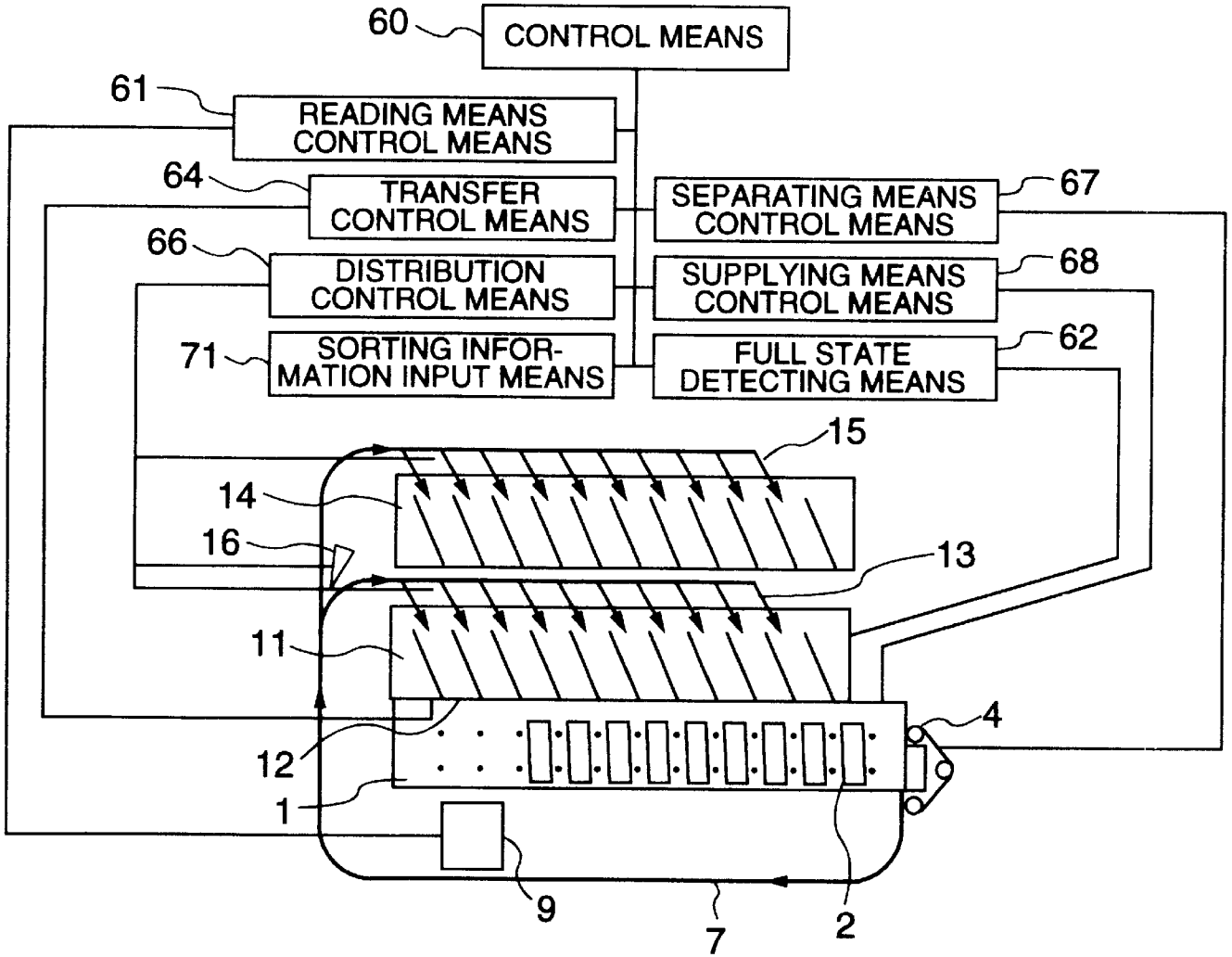
FIG. 8 is an explanatory diagram showing an embodiment of the paper sheet matter sorting apparatus of the present invention.

FIG. 8 is a block diagram showing the construction of an embodiment of the paper sheet sorting apparatus according to the present invention. In FIG. 8, reading means control means 61 can control the reading means 9 and the character reading means 19. Transfer control means 64 can transfer paper sheet matters 2 accumulated in the first accumulating means 11 in a sorted manner so that they are transferred to the supplying means 1 in a sequence as accumulated. An example of such means can be realized by pulling out the bottom plate 12 of the accumulating means 11 to drop the paper sheet matters 2 into the supplying means 1. Distribution control means 66 controls the distributing means 13, 15 and 16. Supplying means control means 68 controls the supplying means 1. Separating means control means 67 controls the separating means 4.

Sorting information input means 71 can input sorting information of the paper sheet matter 2.

Control means 60 controls the reading means control means 61, the transfer control means 64, the distribution control means 66, the separating means control means 67, the supplying means control means 68 and the sorting information input means 71.

Next, a sorting operation according to the present embodiment will be described using flow charts shown in FIGS. 9 to 13.

In the shown example, it is assumed that paper sheet matters 2 are postal matters and postal matters addressed to delivery designations in the territory of a self-office are sorted or rearranged in accordance with designation addresses. It is also assumed that the number of postmen (or carriers) is 30 and the amount of paper sheet matters per postman is about 1000 to 2000 sheets.

Figure 9:
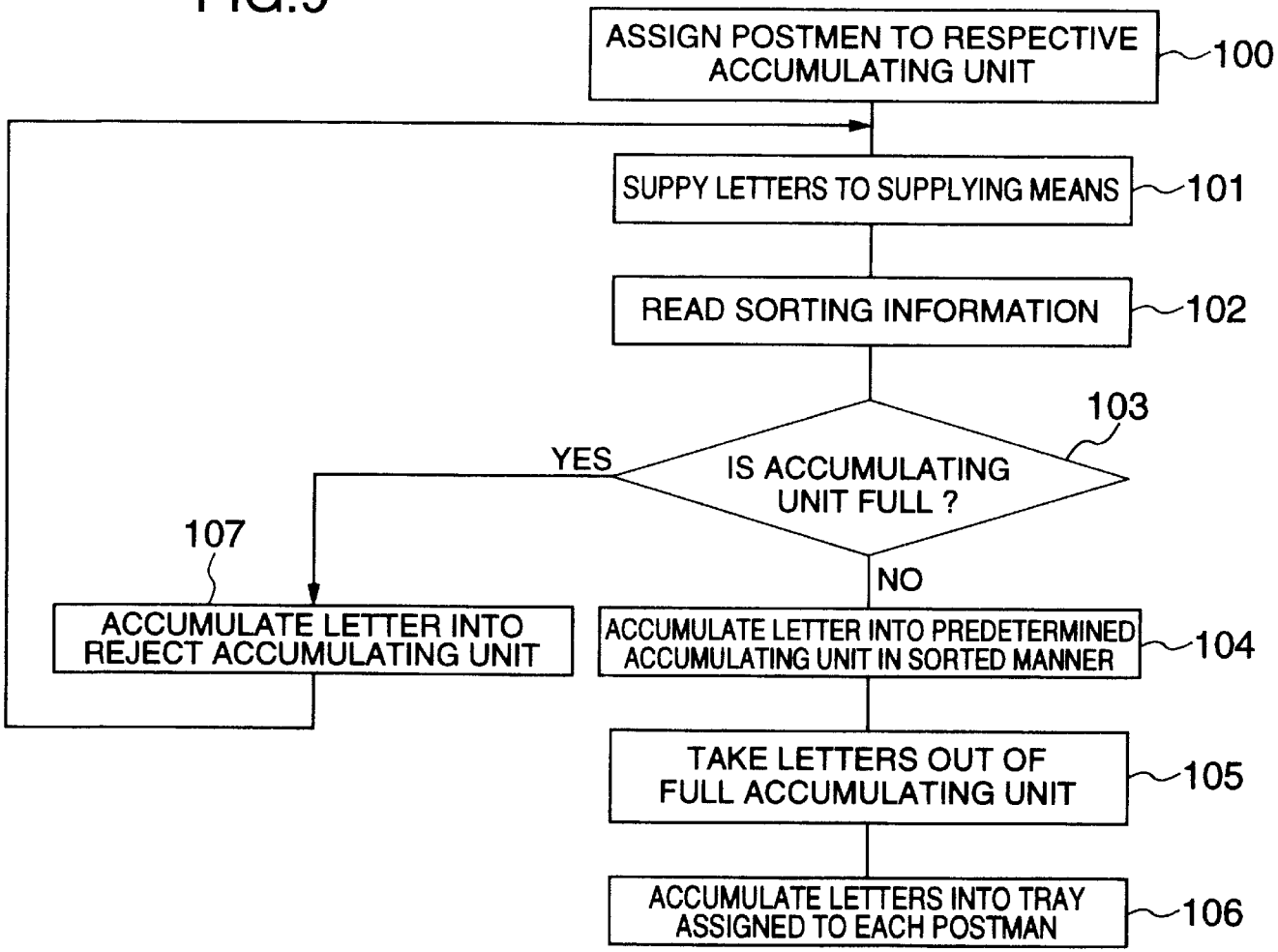
FIG. 9 is an explanatory diagram showing an example of a sorting operation in the paper sheet matter sorting apparatus of the present invention.

FIG. 9 shows an operation of sorting paper sheet matters 2 for each postman. First, delivery information indicating the correspondence of postmen and sorting information 20 denoted on paper sheet matters 2 is inputted from the sorting information input means 71 so that accumulating units in the first accumulating means 11 and the second accumulating means 14 are assigned to the postmen, respectively (procedure 100). Provided that the average number of paper sheet matters per postman is 1500, the total number of paper sheet matters to be sorted comes to 45000. Those paper sheet matters 2 are successively supplied to the supplying means 1 (procedure 101). The paper sheet matters are separated and sorting information of each separated paper sheet matter is then read by the reading means 9 (procedure 102). Each postman is determined in accordance with the result of reading. Thereupon, full state detecting means 62 detects whether or not the corresponding accumulating unit is full (procedure 103). In the case where the corresponding accumulating unit is not full, the paper sheet matter is sorted out and accumulated into the predetermined accumulating unit (procedure 104). In the case where the corresponding accumulating unit is full, the paper sheet matter is accumulated into either the reject accumulating unit 17 or 18 (procedure 107).

Since the number of paper sheet matters to be sorted is 45000 in total and the amount of accumulation by each accumulating unit is about 80 mm at the largest, the respective accumulating units turn into their full states at successive intervals. A worker successively takes paper sheet matters 2 out of the full accumulating unit (procedure 105) to collect them to a tray or box assigned to each corresponding postman (procedure 106).

Paper sheet matters 2 accumulated in the reject accumulating means 17 and 18 are supplied to the supplying means 1 again so that they are subjected to sorting. Since a paper sheet matter 2 rejected by reason of, for example, difficulty in reading a bar code will be accumulated into the reject accumulating unit 17 or 18 again, it is necessary to separately sort that paper sheet matter 2 manually. However, a paper sheet 2 rejected by reason of the full state of the corresponding accumulating unit will be accumulated sorted out and into that accumulating unit when the sorting operation is performed again.

Further, if either the reject accumulating unit 17 or 18 is assigned to the address of a specified large destination such as a department store or a school, paper sheet matters 2 to be delivered to the address of that large destination can be sorted out and accumulated beforehand. Namely, it is not necessary to perform the sorting for delivery sequence organization. Thereby, the efficiency can be improved.

With the above operation, all of paper sheet matters 2 can be sorted for the thirty postmen, respectively. Both the first accumulating means 11 and the second accumulating means 14 are disposed above the supplying means 1 and the lateral width thereof inclusive of the supplying means 1 is approximately 2 m. Namely, a working range in a work for taking out of the accumulating means or a work for supply to the supplying means is about 2 m at the largest and hence the worker can reach the greater part of the working range by stretching arms to right and left. Therefore, a moving range of the worker in the above-mentioned sorting work is small. Accordingly, there is a merit that it is possible to reduce the worker's fatigue, thereby providing a satisfactory working environment.

Next, there will be described a delivery sequence organization sorting operation in which (about 1000 to 2000 sheets of) paper sheet matters 2 having already been sorted for each postman are rearranged in a delivery sequence for about 1000 places of destination for delivery. The description will be made using FIGS. 10 to 15.

Figure 10:
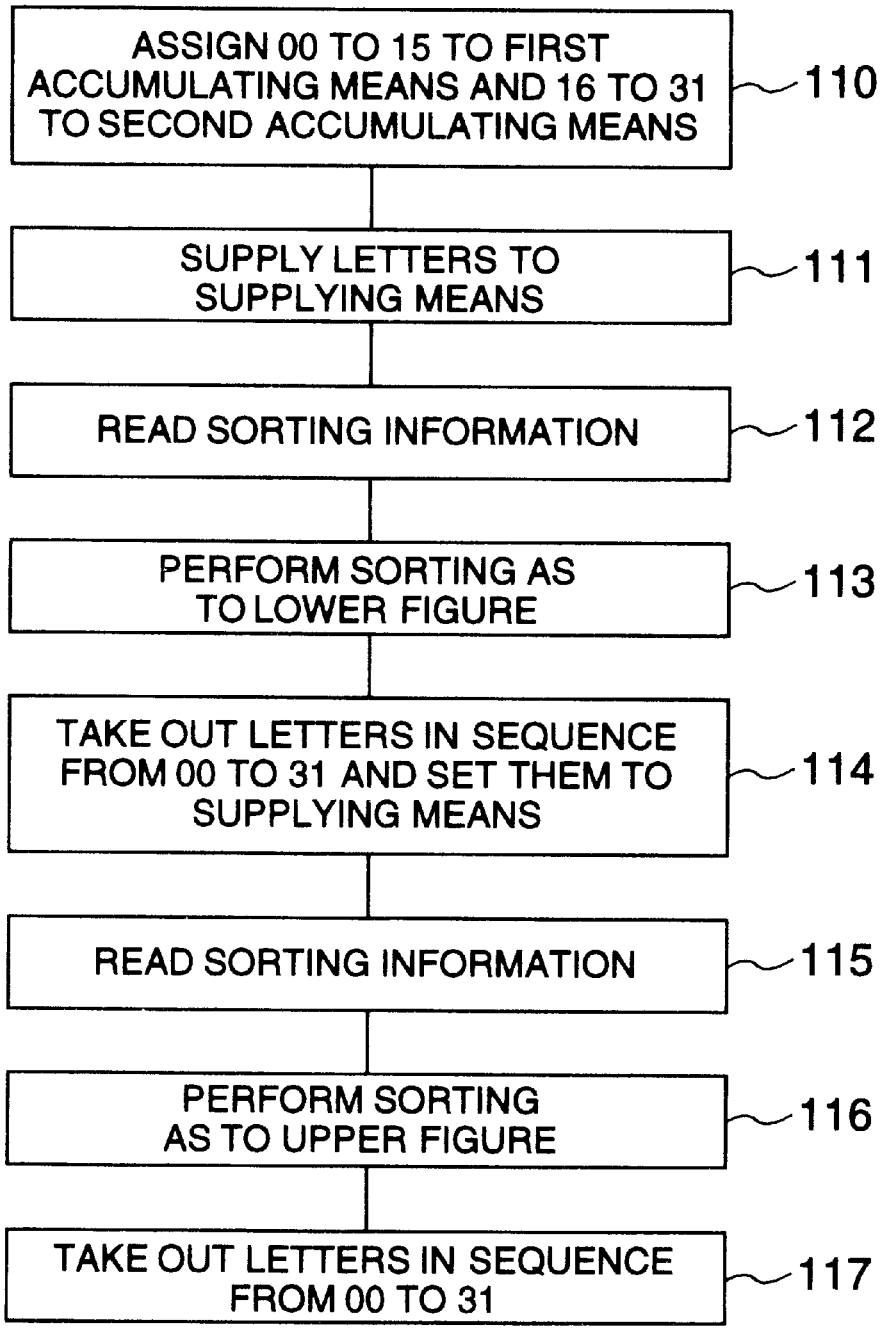
FIG. 10 is an explanatory diagram showing an example of a delivery sequence organizing operation in the paper sheet matter sorting apparatus of the present invention.

FIG. 10 is a flow chart showing a first example of the delivery sequence organization sorting operation. Now, it is assumed that sorting information indicating the destination addresses of the 1000 places are represented by two-figure 32-ary numbers, for example, 00-00 to 31-31. Namely, since the second power of 32 is 1024, the destination addresses of the 1000 places can be represented by two figures and the delivery sequence organization sorting operation can be performed by repeating the sorting into 32 accumulating units two times.

First, delivery sequence information indicating the correspondence of a delivery sequence for each postman and sorting information 20 is inputted from the sorting information input means 71. Now provided that the sorting information is the delivery sequence, 00 to 15 are assigned to the respective accumulating units of the first accumulating means 11 while 16 to 31 are assigned to the respective accumulating units of the second accumulating means 14 (procedure 110). Next, paper sheet matters 2 to be subjected to delivery sequence organization are supplied to the supplying means 1 (procedure 111) and are separated one by one so that sorting information of each separated paper sheet matter is then read by the reading means 9 (procedure 112). As described earlier, the sorting is first performed as to the lower figure of sorting information so that the paper sheet matters are accumulated into the respective accumulating units in the first accumulating means 11 and the second accumulating means 14 in a sorted manner (procedure 113). If the sorting of all of paper sheet matters is completed so that the paper sheet matters are accumulated in the corresponding accumulating units, the paper sheet matters 2 are taken out of the accumulating units in a sequence from 00 to 31 in sorting information and are supplied to the supplying means 1 again taking precautions against a change in sequence (procedure 114).

The paper sheet matters 2 are separated one by one again so that sorting information of each separated paper sheet matter is then read by the reading means 9 (procedure 115). Now, the sorting is performed as to the upper figure of sorting information so that the paper sheet matters are sorted out and accumulated into the respective accumulating units in the first accumulating means 11 and the second accumulating means 14 in a sorted manner (procedure 116). If the sorting of all of paper sheet matters is completed so that the paper sheet matters are accumulated in the corresponding accumulating units, the paper sheet matters 2 are taken out of the accumulating units in a sequence from 00 to 31 in sorting information and are accommodated into a tray or box, taking precautions against a change in sequence.

The sorting into 32 parts is repeated two times through the foregoing procedure, thereby completing a delivery sequence organizing work for the destination addresses of 1000 places. In this case, since the number of times of repetition of the sorting is only 2, there is a merit that a short time suffices for the sorting work.

Figure 11:
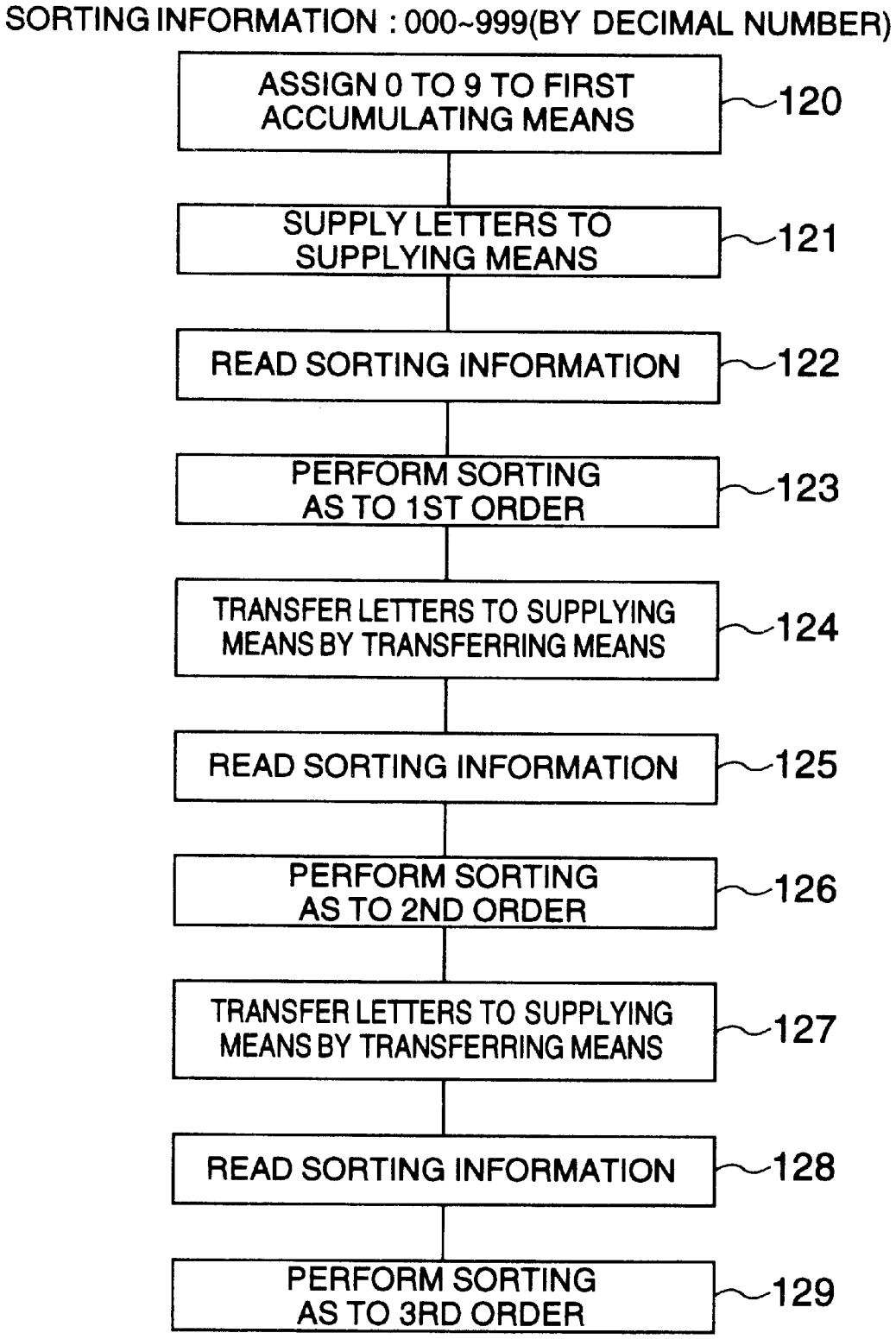
FIG. 11 is an explanatory diagram showing another example of a delivery sequence organizing operation in the paper sheet matter sorting apparatus of the present invention.

FIG. 11 is a flow chart showing a second example of the delivery sequence organization sorting operation. The present example corresponds to the case where the amount of paper sheet matters to be subjected to delivery sequence organization sorting is small so that the paper sheet matters can be accommodated in only the first accumulating means 11.

In a manner similar to that in the first example, delivery sequence information indicating the correspondence of a delivery sequence for each postman and sorting information 20 is first inputted from the sorting information input means 71, thereby assigning 0 to 9 to the respective accumulating units of the first accumulating means 11 (procedure 120). Next, paper sheet matters 2 to be subjected to delivery sequence organization are supplied to the supplying means 1 (procedure 121) and are separated one by one so that sorting information of each separated paper sheet matter is then read by the reading means 9 (procedure 122). The sorting is first performed as to the 1st order (or the order of 1) of sorting information so that the respective paper sheet matters are accumulated into the accumulating units of the first accumulating means 11 in a sorted manner (procedure 123).

If the sorting of all of paper sheet matters is completed so that the paper sheet matters are accumulated in the corresponding accumulating units, the bottom plate 12 is pulled out by the transfer control means 64 so that the paper sheet matters 2 in the first accumulating means 11 are dropped and transferred into the supplying means 1 (procedure 124). Next, the paper sheet matters are separated one by one again so that sorting information of the separated paper sheet matter is then read by the reading means 9 (procedure 125). Now, the sorting is performed as to the 2nd order (or the order of 10) of sorting information so that the respective paper sheet matters are accumulated into the accumulating units of the first accumulating means 11 in a sorted manner (procedure 126).

If the sorting of all of paper sheet matters is completed so that the paper sheet matters are accumulated in the corresponding accumulating units, the bottom plate 12 is pulled out by the transfer control means 64 again so that the paper sheet matters 2 in the first accumulating means 11 are dropped and transferred into the supplying means 1 (procedure 127). The paper sheet matters are separated one by one again so that sorting information of the separated paper sheet matter is then read by the reading means 9 (procedure 128). Now, the sorting is performed as to the 3rd order (or the order of 100) of sorting information so that the respective paper sheet matters are accumulated into the accumulating units of the first accumulating means 11 in a sorted manner (procedure 129).

The sorting into 10 parts is repeated three times through the foregoing procedure, thereby completing a delivery sequence organizing work for the destination addresses of 1000 places. In this case, since all of paper sheet matters 2 accumulated in the first accumulating means 11 are automatically transferred to the supplying means 1 by pulling out the bottom plate 12, the first supply of paper sheet matters 2 to the supplying means 1 and the taking-out of paper sheet matters 2 after the completion of all of operations suffice as a manual work, thereby enabling a labor saving.

Figure 12:
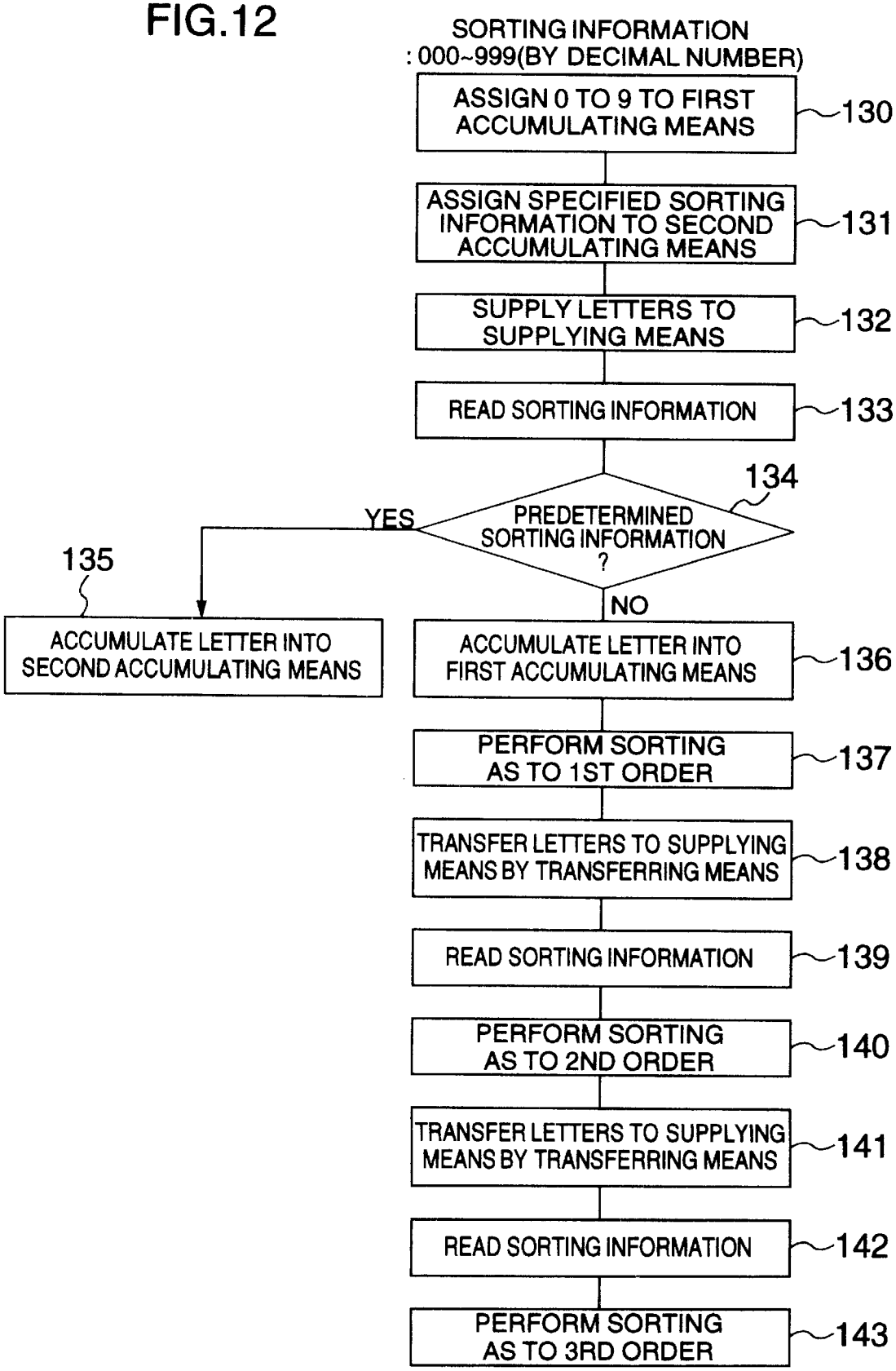
FIG. 12 is an explanatory diagram showing a further example of a delivery sequence organizing operation in the paper sheet matter sorting apparatus of the present invention.

FIG. 12 is a flow chart showing a third example of the delivery sequence organization sorting operation. The present example corresponds the case where a delivery distinct includes the address of a large destination such as a department store or a school having a very large number of paper sheet matters 2 to be delivered and the number of paper sheet matters to be delivered to the other destination addresses is relatively small.

Procedures from the inputting of delivery sequence information to the reading of sorting information (or procedures 130 to 133) and the assignment of sorting information to the first accumulating means 11 are the same as those in the second example.

A difference of the third example from the second example lies in that with specified sorting information representative of the large destination being determined beforehand, the judgement is made, at the time of reading of sorting information 20, as to whether or not the read sorting information is the specified sorting information (procedure 134) and in the case of the specified sorting information representing the large destination, the corresponding paper sheet matters are accumulated into any accumulating unit(s) in the second accumulating means 14 (procedure 135). In the case where the read sorting information is not the specified sorting information, the paper sheet matter is accumulated into an accumulating unit in the first accumulating means 11 in accordance with the sorting information (procedure 136).

Now, in the case where the delivery distinct includes a plurality of large destinations, the second accumulating means 14 may be divided into, for example, two groups each including eight accumulating units so that those groups are assigned to two different large destinations.

The operations for procedures 137 to 143 are similar to those for procedures 123 to 129 shown in FIG. 10 in conjunction with the second example. If the sorting of all paper sheet matters is completed, the paper sheet matters are taken out of the first accumulating means 11 and the second accumulating means 14.

According to the third example as mentioned above, in the case where a large destination is included in a delivery distinct, the delivery sequence organization for all paper sheet matters excepting ones addressed to the large destination can be completed by repeating the sorting operation automatically in a manner similar to that in the second example. The first supply of paper sheet matters 2 to the supplying means 1 and the takingout of paper sheet matters 2 after the completion of all of operations suffice as a manual work, thereby enabling a labor saving.

A fourth example of the delivery sequence organization sorting operation will be described using FIGS. 13 to 15. The present example corresponds to an operation in the case where the number of paper sheet matters is large as 2000.

Figure 13:
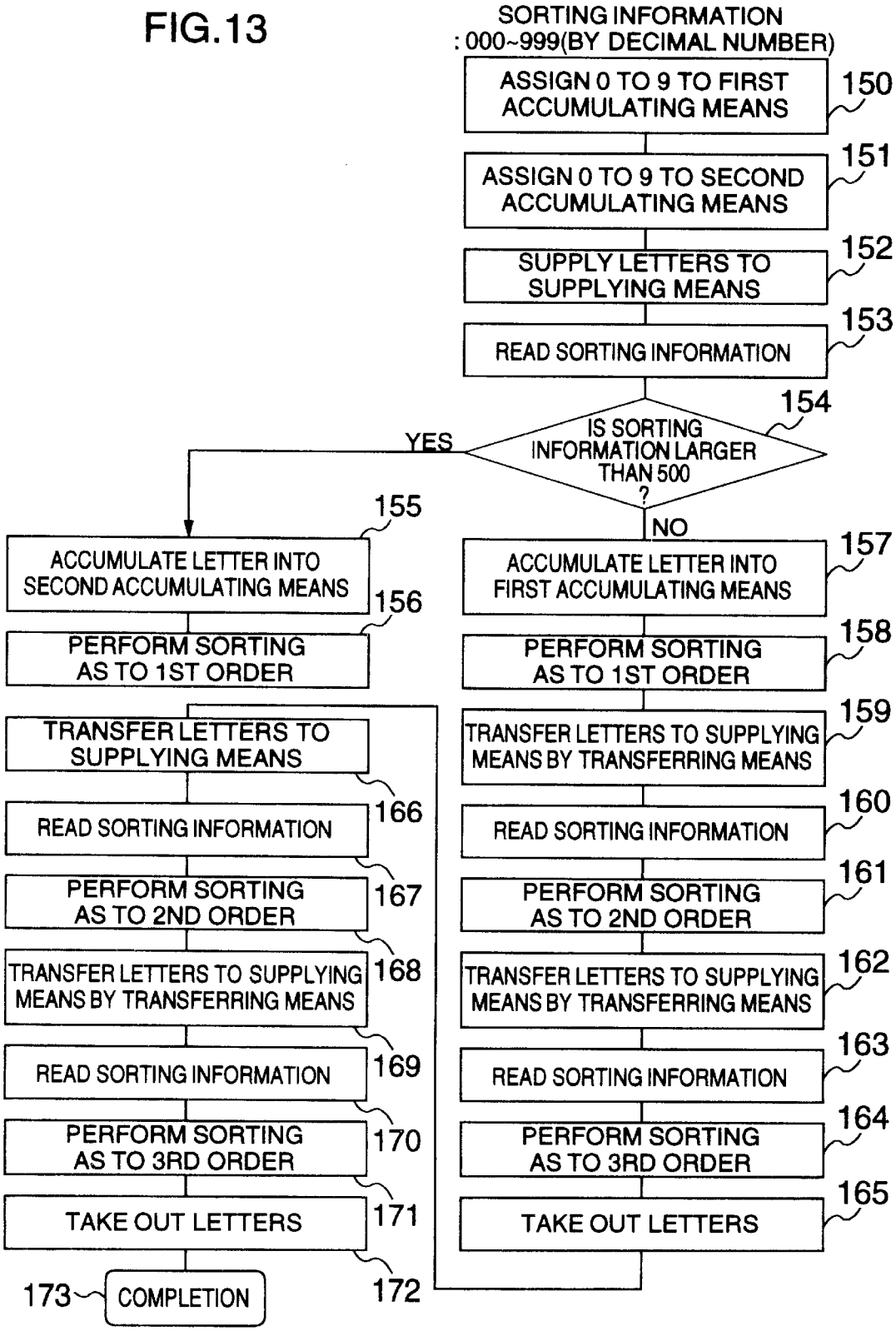
FIG. 13 is an explanatory diagram showing a still further example of a delivery sequence organizing operation in the paper sheet matter sorting apparatus of the present invention.
Figure 14:
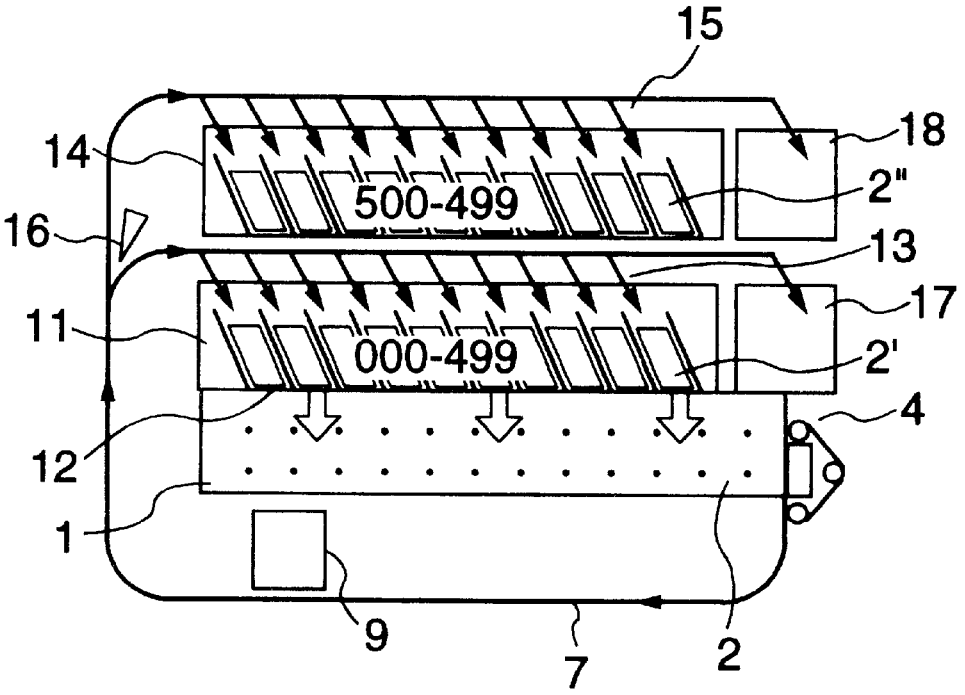
FIG. 14 is an explanatory diagram showing an example of a sorting operation in the paper sheet matter sorting apparatus of the present invention.

FIG. 13 is a flow chart showing the fourth example of the delivery sequence organization sorting operation.

In a manner similar to that in the first to third examples, delivery sequence information indicating the correspondence of a delivery sequence for each postman and sorting information 20 is first inputted from the sorting information input means 71 so that 0 to 9 are assigned to the respective accumulating units of the first accumulating means 11 (procedure 150). And, 0 to 9 are also assigned to the respective accumulating units of the second accumulating means 14 (procedure 151). Next, paper sheet matters 2 to be subjected to delivery sequence organization are supplied to the supplying means 1 (procedure 152) and are separated one by one so that sorting information of each separated paper sheet matter is then read by the reading means 9 (procedure 153).

Next, the judgement is made of whether or not the sorting information is not smaller than 500 (procedure 154). In the case where the sorting information 20 is 500 to 999, the corresponding paper sheet matter is conveyed to the second accumulating means 14 and is then sorted out and accumulated into the corresponding accumulating unit in accordance with the 1st order of the sorting information 20 (procedures 155 to 156).

In the case where the sorting information 20 is 000 to 499, the corresponding paper sheet matter is conveyed to the first accumulating means 11 and is then sorted and accumulated into the corresponding accumulating unit in accordance with the 1st order of the sorting information 20 (procedure 157). FIG. 14 shows a state in which as the result of completion of procedures up to procedure 157, the supplied paper sheet matters 2 are accumulated in the first accumulating means 11 and the second accumulating means 14. Namely, paper sheet matters 2' of 000 to 499 in sorting information 20 are accumulated in the first accumulating means 11 and paper sheet matters 2" of 500 to 999 in sorting information 20 are accumulated in the second accumulating means 14. In each accumulating means, paper sheet matters 2 matched in respect to only the 1st-order digit of sorting information 20 are sorted out and accumulated in each accumulating unit.

Procedures from procedure 158 to procedure 164 are the same as those from procedure 123 to procedure 129 shown in FIG. 10 in conjunction with the first example.

When procedures up to procedure 164 is completed, the rearrangement of paper sheet matters 2 of 000 to 499 in sorting information 20 according to a delivery sequence is completed and hence those paper sheet matters 2 are taken out (procedure 165) and are accumulated into a tray or box. Next, paper sheet matters 2 of 500 to 999 in sorting information 20 accumulated in the second accumulating means 14 are transferred to the supplying means 1, taking precautions against a change in sequence (procedure 166). These paper sheet matters 2 having already been subjected to the sorting as to the 1st order are subjected to the sorting as to the 2nd order and the sorting as to the 3rd order. Procedures 167 to 171 therefor are the same as procedures 160 to 164.

Figure 15:
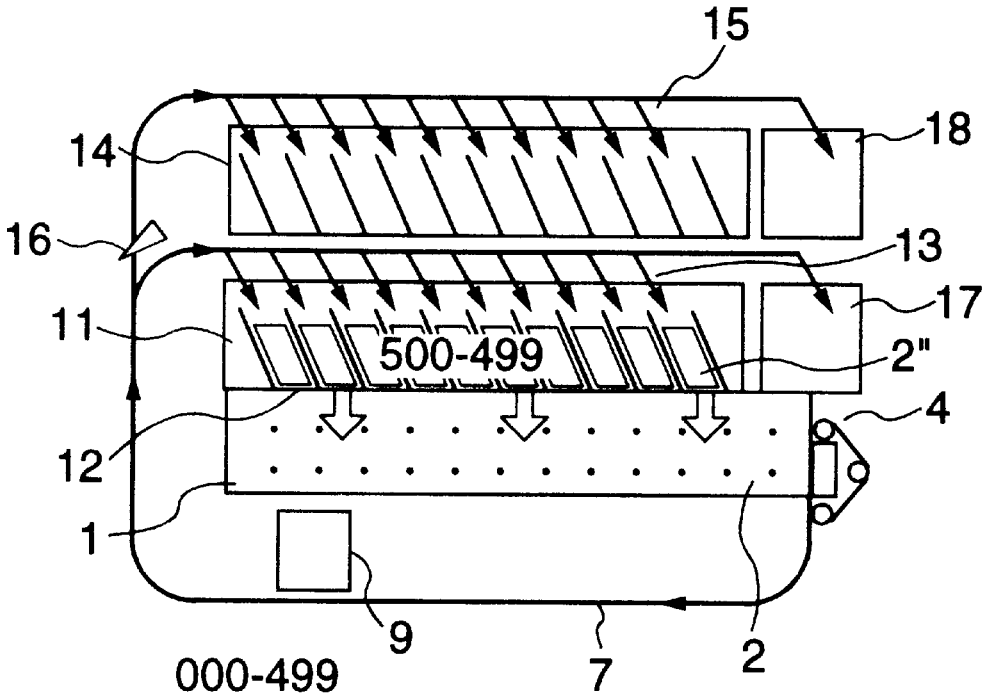
FIG. 15 is an explanatory diagram showing another example of a sorting operation in the paper sheet matter sorting apparatus of the present invention.

FIG. 15 shows a state in which as the result of completion of procedures up to procedure 171, the rearrangement of paper sheet matters 2 of 500 to 999 in sorting information 20 is completed. When those paper sheet matters 2 are taken out (procedure 173) and are then connected to paper sheet matters 2 of 000 to 499 in sorting information 20 having already been taken out in procedure 165, there results in that all of paper sheet matters 2 of 000 to 999 are rearranged in a delivery sequence.

According to the above procedure, the number of times of transfer of paper sheet matters 2 by a worker is only one corresponding to procedure 166 (which corresponds to 1000 sheets), thereby making it possible to reduce a load imposed on the worker.

In the above example, the delivery sequence organization of paper sheet matters 2 of 000 to 499 in sorting information 20 is precedently performed by the accumulation thereof into the first accumulating means 11. Reversely, however, even in the case where the delivery sequence organization of paper sheet matters 2 of 500 to 999 in sorting information 20 is precedently performed by the accumulation thereof into the first accumulating means 11 and the delivery sequence organization of paper sheet matters 2 of 000 to 499 in sorting information 20 is performed by the accumulation thereof into the second accumulating means 14 and the transfer of the accumulated paper sheet matters to the supplying means 1, the delivery sequence organization from 000 to 999 can be effected similarly.

In procedure 154 of the shown example, the judgement is made of whether or not the sorting information 20 is not smaller than 500. However, for example, in the case where it is known that the amount of paper sheet matters 2 not larger than 500 in sorting information is relatively large, the judgement of the sorting information as being not smaller than 400 is more preferable since a difference between the amount of paper sheet matters 2 to be accumulated in the first accumulating means 11 and the amount of paper sheet matters 2 to be accumulated in the second accumulating means 14 becomes small.

Figure 16:
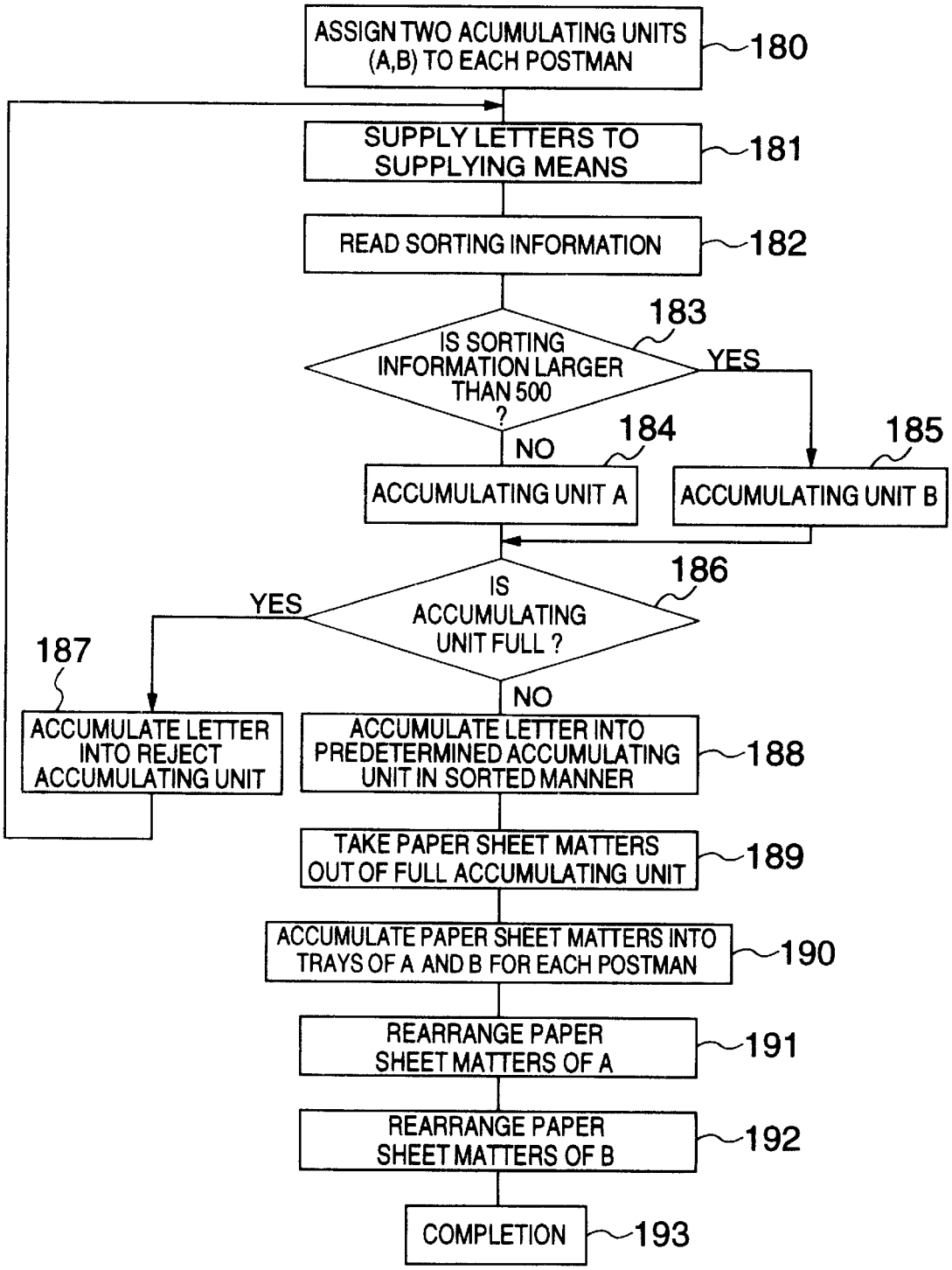
FIG. 16 is an explanatory diagram showing another example of a delivery sequence organizing operation in the paper sheet matter sorting apparatus of the present invention.

Next, another example of performing a delivery sequence organization sorting operation after the sorting of paper sheet matters 2 for each postman will be described using FIG. 16. The present example corresponds to the case where the number of paper sheet matters is large as 2000.

First, delivery information indicating the correspondence of postmen and sorting information 20 denoted on paper sheet matters 2 is inputted from the sorting information input means 71 so that two accumulating units including one in the first accumulating means 11 and the other in the second accumulating means 14 (hereinafter referred to as A and B, respectively) are assigned to each postman (procedure 180). Accordingly, for example, provided that the total number of accumulating units is 32, two accumulating units are assigned to each of postmen whose number is 16 at the greatest.

Next, paper sheet matters 2 are supplied to the supplying means 1 (procedure 181). The paper sheet matters are separated and sorting information of each separated paper sheet matter is then read by the reading means 9 (procedure 182). Each postman is determined in accordance with the result of reading. Further, the judgement is made of whether or not the sorting information 20 is not smaller than 500 (procedure 183). In the case where the sorting information is 000 to 499, the corresponding paper sheet matter is accumulated into the accumulating unit of A (procedure 184). In the case where the sorting information is 500 to 999, the corresponding paper sheet matter is accumulated into the accumulating unit of B (procedure 185). Namely, paper sheet matters 2 having a delivery sequence of the first half are accumulated into the accumulating units of A and paper sheet matters 2 having a delivery sequence of the latter half are accumulated into the accumulating units of B.

Thereupon, the full state detecting means 62 detects whether or not the corresponding accumulating unit is full (procedure 186). In the case where the corresponding accumulating unit is not full, the paper sheet matter is sorted out and accumulated into the predetermined accumulating unit (procedure 188). In the case where the corresponding accumulating unit is full, the paper sheet matter is accumulated into either the reject accumulating unit 17 or 18 (procedure 187). A worker successively takes paper sheet matters 2 out of the full accumulating unit (procedure 189). Paper sheet matters 2 taken out of the accumulating units of A and B for each postman are collected into separate trays or boxes, respectively (procedure 190).

With the foregoing procedure, paper sheet matters 2 are collected in a manner divided into paper sheet matters 2 with a delivery sequence of the first half and paper sheet matters 2 with a delivery sequence of the latter half for each postman.

Next, the paper sheet matters 2 of A having a delivery sequence of the first half are first supplied to the supplying means 1 to perform the rearrangement thereof (procedure 191). This procedure is similar to procedures 120 to 129 shown in FIG. 11 but the sorting information 20 corresponds to 500 places of 000 to 499 in the first half. However, in the sorting as to the 3rd order, the sorting into five parts of 0 to 4 suffices. For example, three accumulating units may be assigned to one numeric value (or digit). If the rearrangement is completed, the paper sheet matters 2 of A are taken out and the paper sheet matters 2 of B having a delivery sequence of the latter half are supplied to the supplying means 1 to perform the rearrangement thereof (procedure 192). This procedure is similar to procedures 120 to 129 shown in FIG. 11 but the sorting information 20 corresponds to 500 to 999 in the latter half. However, in the sorting as to the 3rd order, the sorting into five parts suffices as in the first half. If the rearrangement is completed, the paper sheet matters 2 of B are taken out.

When the paper sheet matters 2 of A and the paper sheet matters 2 of B having been subjected to rearrangement are connected, all paper sheet matters 2 per postman are rearranged in sequence in accordance with sorting information 20 of 000 to 999, thereby completing a rearranging work (procedure 193).

Figure 17:
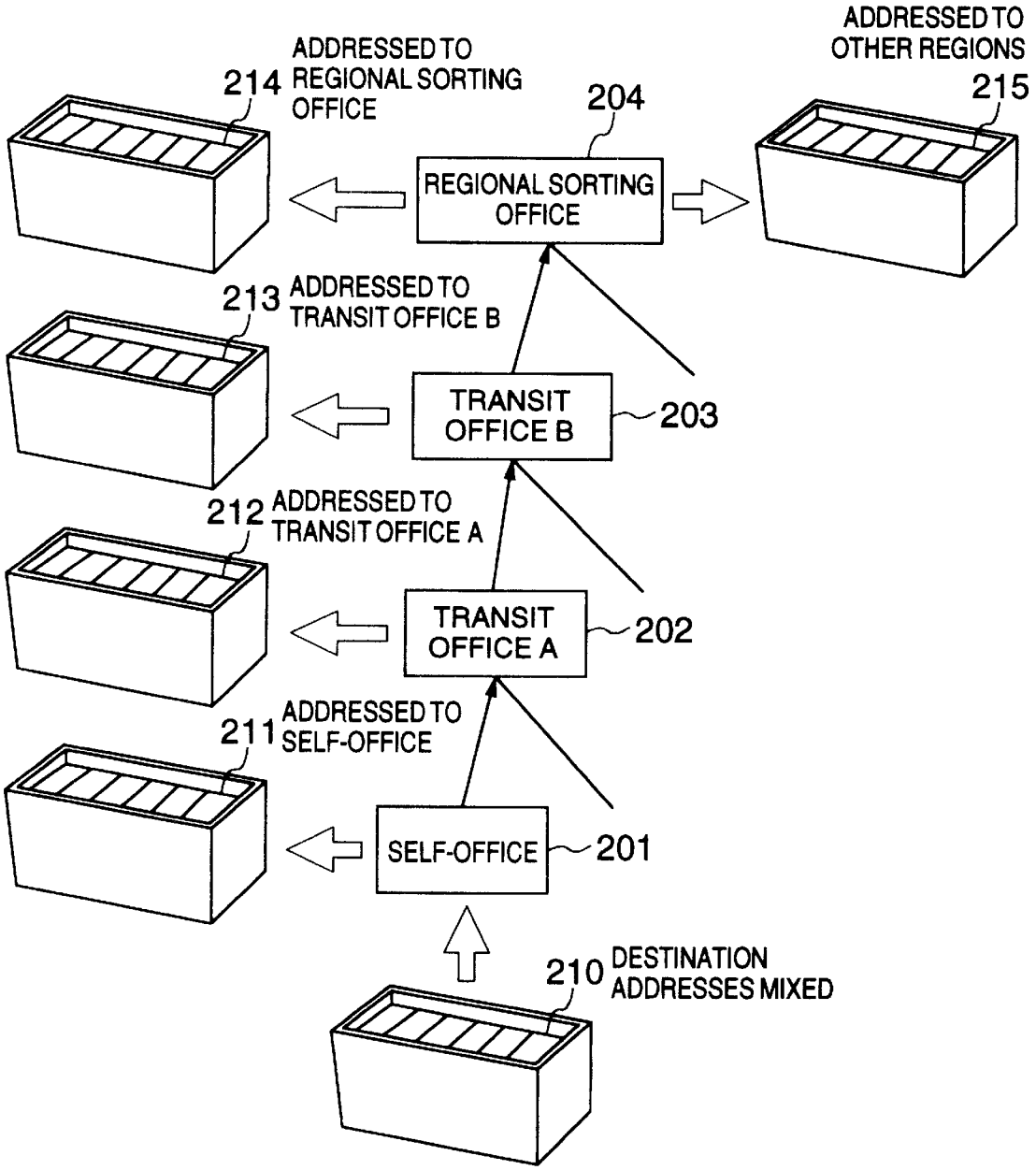
FIG. 17 is an explanatory diagram showing an example of a sorting operation in the paper sheet matter sorting apparatus of the present invention.

Next, another embodiment will be described by use of FIGS. 17 and 18 in conjunction with an example of an operation for performing the sorting of postal matters which are posted in the delivery territory of a self-office and have the mixture of various destination addresses. In FIG. 17, for example, when postal matters posted into mailboxes are collected, the collected postal matters 210 are placed in a state in which ones addressed to all over the whole of Japan are mixed. Also, for example, it is assumed that postal matters directed from the self-office 201 to other areas are sent through relay offices A and B to a regional sorting office coordinating each area and are further transmitted from that regional sorting office to respective regional sorting offices for other areas. Now provided that the whole country is divided into 100 areas, it is necessary that postal matters addressed to the other areas should be sorted into 100 parts corresponding to the 100 places. Accordingly, there is required a sorter which can perform the sorting into at least 100 parts.

Consider the case where the sorting of postal matters with destination addresses in the other areas into the respective areas is tried in the self-office. If the introduction of a sorter enabling the sorting into at least 100 parts is difficult, for example, due to the insufficiency of a space for installation, the sorting apparatus according to the present invention as shown in FIG. 1 cannot perform the sorting into 100 parts since the number of accumulating units is insufficient. Therefore, a work for sorting into the respective areas must be performed manually, which does not provide the sufficient effect of mechanization.

Thus, the collected postal matters 210 are sorted as follows. Namely, they are sorted into postal matters 211 to be delivered by the self-office 201, postal matters 212 addressed to the delivery territory of the transit office A 202, postal matters 213 addressed to the delivery territory of the relay office B 203, postal matters 214 addressed to the delivery territory of the regional sorting office, and postal matters 215 addressed to the other areas. Such sorting can be realized, for example, if a postal code (or ZIP code) denoted on a postal matter corresponds to a post office of destination. Namely, it can be realized by reading a postal code of a postal matter and sorting out and accumulating the postal matter in accordance with the result of reading.

Even if the sorting into 5 parts at the largest is performed by the self-office as in the embodiment shown in FIG. 17, the relay office 202 or 203 is only requested to extract the postal matters 212 or 213 addressed thereto and to transport the remaining postal matters. Thereby, the simplification of a sorting work is attained and the working efficiency is improved.

Figure 18:
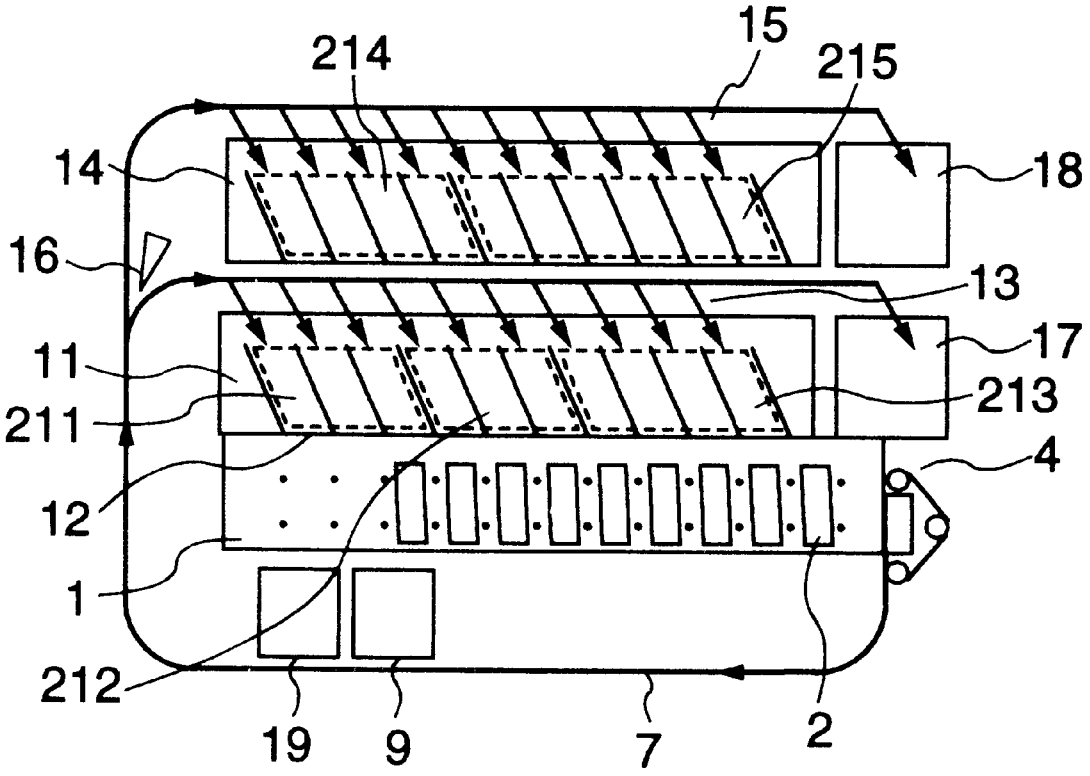
FIG. 18 is an explanatory diagram showing another example of a sorting operation in the paper sheet matter sorting apparatus of the present invention.

FIG. 18 shows an example of the case where such a sorting work is performed.

In the example shown in FIG. 18, the assignment of eleven accumulating units in the first accumulating means 11 is such that three accumulating units are assigned for accumulating the postal matters 211 to be delivered by the self-office 201, three accumulating units are assigned for accumulating the postal matters 212 addressed to the delivery territory of the relay office A 202 and four accumulating units are assigned for accumulating the postal matters 213 addressed to the delivery territory of the relay office B 203 whereas the assignment of eleven accumulating units in the second accumulating means 11 is such that four accumulating units are assigned for accumulating the postal matters 214 addressed to the delivery territory of the regional sorting office 204 and six accumulating units are assigned for accumulating the postal matters 215 addressed to the other areas. The number of accumulating units to be assigned can be selected properly in accordance with the average amount of postal matters to be processed everyday. For example, in the case where the amount of postal matters addressed to the self-office is very small, only one accumulating unit may be assigned.

If accumulating units are assigned as shown in FIG. 18, postal matters to be directed from the self-office 201 to the respective offices up to the regional sorting office 214 can be sorted by taking the sorted and accumulated postal matters out of the respective corresponding accumulating units and loading the taken postal matters, for example, into trays or boxes determined in accordance with the respective destinations. The sorted-out postal matters 212, 213, 214 and 215 other than those addressed to the self-office are all sent to the relay office A 202 which in turn extracts the postal matters 212 addressed to the relay office A 202 to deliver them. Similarly, in each of the relay office B 203 and the regional sorting office 204, the postal matters addressed to that office are extracted and delivered. The postal matters 215 addressed to the other areas are composed of the mixture of postal matters addressed to the respective areas. These postal matters are sorted by the regional sorting office 204 in accordance with the respective areas of destinations.

In the shown embodiment, the postal matters 215 addressed to the other areas are sorted by the regional sorting office 204 in accordance with the respective areas of destinations. However, for example, in the case where the relay office A 202 is provided with a sorter capable of performing the sorting into 100 or more parts, the relay office A 202 may perform the sorting of postal matters according to the respective areas of destinations to transport the sorted postal matters to the relay office B.

In the present embodiment, it is assumed that in the self-office 201, the postal matters 215 addressed to the other areas are composed of the mixture of postal matters addressed to the respective areas. However, the sorting may be made finer in less than the number of accumulating units of the first accumulating means 11 and the second accumulating means 14. For example, the sorting into two parts including one addressed to the Tokyo Metropolis and the other addressed to others is possible.

Figure 19:
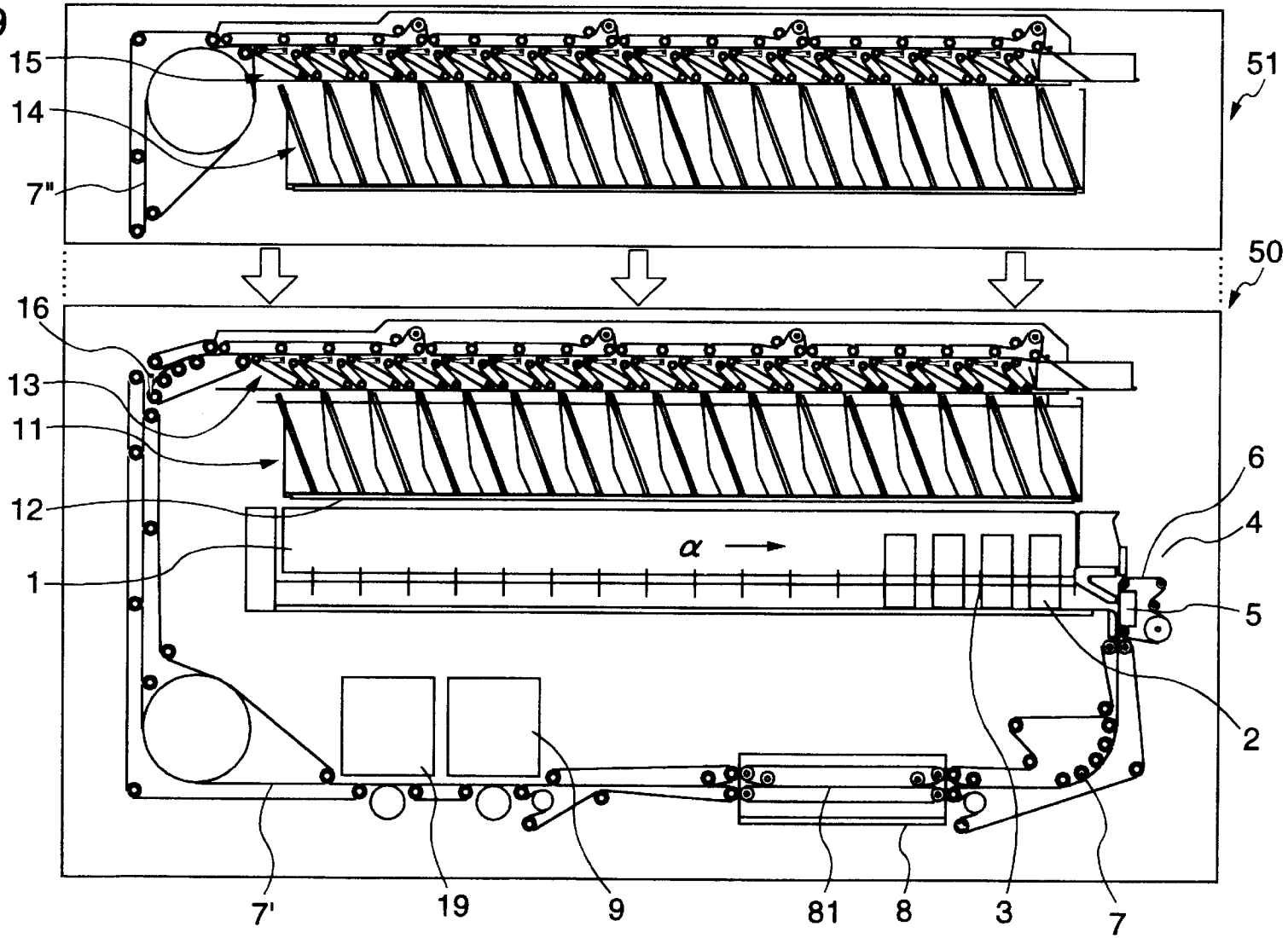
FIG. 19 is a front view showing another embodiment of the paper sheet matter sorting apparatus of the present invention.

Next, an example of the other construction of the paper sheet matter sorting apparatus according to the present invention is shown in FIG. 19. In FIG. 19, numeral 50 denotes a first unit in which the second accumulating means 14, the second distributing means 15 and the gate means 16 are removed from the construction shown in FIG. 1, and numeral 51 denotes a second unit which is provided with the second accumulating means 14, the second distributing means 15 and the gate means 16. The second unit 51 is detachably supported just above the first unit 50. When the first unit 50 and the second unit 51 are connected, there can be obtained a construction which is quite the same as the construction shown in FIG. 1.

With the construction including only the first unit 50, accumulating units for paper sheet matters 2 consist of only the first accumulating means 11. Therefore, for example, the number of accumulating units is 16 and the amount of paper sheet matters 2 capable of being processed is about 1000 sheets which is a half of the amount of paper sheet matters capable of being processed by the construction shown in FIG. 1. Since the number of accumulating units is 16, the work of sorting for each postman as shown in FIG. 9 can be performed if the number of postmen is not larger than 16.

A rearranging work can be performed, for paper sheet matters 2 up to 1000 sheets, in a manner similar to that in the embodiment shown in FIG. 1.

The rearranging work for paper sheet matters 2 including the address of a large destination (or specified sorting information 20) may be performed in such a manner that the specified sorting information 20 is assigned to, for example, three of sixteen accumulating units and paper sheet matters with the large-destination address are accumulated, in procedure 135 of FIG. 12, into the three accumulating units assigned instead of the second accumulating means 14.

For example, if the number of postmen is not larger than 8, two accumulating units can be assigned to each postman. Then, the sorting and rearrangement for each postman can be performed in a procedure similar to that shown in FIG. 16. Since the rearrangement of 1000 sheets is possible in each of procedures 191 and 192, the rearrangement per postman is possible up to 2000 sheets.

Even in the case where the number of postmen is larger than 8, the rearrangement per postman up to 2000 sheets is possible in a manner similar to that in the construction of FIG. 1 if postal matters can be sorted into 1000 sheets in the first half of a delivery sequence for each postman and 1000 sheets in the latter half thereof by another sorting means, for example, a separately installed sorting apparatus.

Further, since the sorting in less than the number of accumulating units is possible, the sorting of loaded paper sheet matters 2 into five parts according to destination addresses as in the example shown in FIG. 17 is possible in a manner similar to that in the example shown in FIG. 18.

As described in the foregoing, even with the construction by only the first unit 50, the works for the sorting for each postman, the sorting for delivery sequence organization and the sorting work for each destination address can be performed in the case where the number of postmen is small or in the case where the number of paper sheet matters 2 per postman is small.

If the second unit 51 is detachably constructed, a proper construction can be provided in accordance with the number of postmen and the number of paper sheet matters 2 to be processed.

In the present invention, a small-size sorter including a supplying section and an accumulating section each having about 2 m can be used so that paper sheet matters having sorting information indicated thereon, for example, postal matters are rearranged in a sequence designated by the sorting information. In one example in which the sorting information represents the address of destination of a postal matter and the arrangement of addresses are associated with a delivery sequence of postal matters, supplied postal matters can be rearranged in the delivery sequence.

Further, since a supplying section, first accumulating means and second accumulating means are adjacent to each other in an up/down direction, the overall width of the apparatus is about 3 m at the largest and hence such an apparatus can be installed even at a small-scale post office.

Further, since first accumulating means and supplying means are adjacent to each other in an up/down direction, the provision of means for opening the bottom surface of the sorting section makes it possible to drop and move postal matters from the sorting section to the supplying means. With such a construction, sorted postal matters can be supplied to the supplying means again without the intervention of a manual work, thereby making it possible to automatically perform the delivery sequence organization of postal matters.

Further, the number of paper sheet matters to be processed for the delivery sequence organization thereof can be increased by dividing supplied postal matters into ones in the first half of a delivery sequence and ones in the latter half thereof so that they are respectively accumulated into first accumulating means and second accumulating means, precedently performing the automatical delivery sequence organization of only postal matters in the first half, thereafter transferring postal matters in the latter half to a supplying section, and subsequently performing the automatical delivery sequence organization of postal matters in the latter half.

Further, with a construction in which accumulating units in first accumulating means and second accumulating means are made about 32 in number, it is possible not only to sort postal matters for respective postmen but also to perform the delivery sequence organization of about 1000 destination addresses by merely repeating the sorting two times, thereby enabling the shortening of a time required for the delivery sequence organization.

Further, a small-size sorter including a small number of accumulating units can be used for reading the postal codes of collected postal matters and sorting them into ones addressed to a self-office, a relay office, an area sorting office and other areas, respectively, thereby making it possible to simplify the sorting of postal matters addressed to areas extending from the self-office to the area sorting office.

We claim:

1. A paper sheet matter sorting apparatus comprising: supplying means for supplying a plurality of paper sheet matters, separating means for separating the paper sheet matters one by one, reading means for reading sorting information recorded on the paper sheet matters, first accumulating means disposed above and adjacent to said supplying means and having a plurality of accumulating units, second accumulating means disposed above and adjacent to said first accumulating units, and conveying means for conveying the paper sheet matters from said separating means to said first accumulating means or said second accumulating means, wherein each of said first and second accumulating means include an additional accumulating unit of a large capacity.

2. A paper sheet matter sorting apparatus according to claim 1, wherein said first accumulating means includes letter transferring means by which the paper sheet matters accumulated in the plurality of accumulating units of said first accumulating means are transferred to said supplying means without change of the sequence of said paper sheet matters accumulated in the plurality of accumulating units of said first accumulating means.

3. A paper sheet matter sorting apparatus according to claim 2, wherein said paper sheet matters are rearranged in a predetermined sequence in accordance with said sorting information by accumulating the paper sheet matters supplied to said supplying means into the plurality of accumulating units of said first accumulating means in a sorted manner in accordance with the sorting information on said paper sheet matters, said paper sheet matters thereafter being transferred to said supplying means by said letter transferring means, and said paper sheet matters thereafter again being sorted into the plurality of accumulating units of said first accumulating means in a sorted manner in accordance with the sorting information on said paper sheet matters.

4. A paper sheet matter sorting apparatus according to claim 3, wherein when the paper sheet matters supplied to said supplying means are accumulated into the plurality of accumulating units of said first accumulating means in a sorted manner in accordance with the sorting information denoted on said paper sheet matters, only paper sheet matters having at least one kind of specified sorting information denoted thereon are accumulated into the accumulating units of said second accumulating means.

5. A paper sheet matter sorting apparatus according to claim 3, wherein when the paper sheet matters supplied to said supplying means are accumulated in a sorted manner on the basis of the sorting information on said paper sheet matters for every paper sheet matters concerned with the same delivery territory, first paper sheet matters with the sorting information thereof belonging to a sequence earlier than predetermined sorting information belonging to the delivery territory and second paper sheet matters with the sorting information thereof belonging to a sequence later than said predetermined sorting information are accumulated into separate accumulating units in a sorted manner, only said first paper sheet matters are thereafter supplied to said supplying means and rearranged in a predetermined sequence in accordance with the sorting information provided on said paper sheet matters, and only said second paper sheet matters are thereafter supplied to said supplying means and rearranged in a predetermined sequence in accordance with the sorting information denoted on said paper sheet matters.

6. A paper sheet matter sorting apparatus according to claim 2, wherein the paper sheet matter supplied to said supplying means is accumulated into said first accumulating means in a sorted manner in the case where the sorting information on the paper sheet matter belongs to a sequence earlier than predetermined sorting information and into said second accumulating means in a sorted manner in the case where it belongs to a sequence later than said predetermined sorting information, the paper sheet matters accumulated into said first accumulating means in a sorted manner are rearranged in a predetermined sequence in accordance with said sorting information by transferring said paper sheet matters to said supplying means by said letter transferring means and said paper sheet matters thereafter again being sorted into the plurality of accumulating units of said first accumulating means in a sorted manner in accordance with the sorting information on said paper sheet matters, and the paper sheet matters accumulated into said second accumulating means in a sorted manner are thereafter rearranged in a predetermined sequence in accordance with said sorting information by transferring said paper sheet matters to said supplying means by said letter transferring means and thereafter repeating a sorting operation of accumulating said paper sheet matters into said first accumulating means in a sorted manner in accordance with the sorting information denoted on said paper sheet matters.

7. A paper sheet matter sorting apparatus according to claim 1, wherein said second accumulating means is detachable.

8. A paper sheet matter sorting apparatus comprising supplying means for supplying a plurality of paper sheet matters having sorting information thereon, separating means for successively separating and taking out the paper sheet matters supplied by said supplying means, reading means for reading the sorting information from the paper sheet matters taken out by said separating means, first accumulating means disposed above and adjacent to said supplying means and having a plurality of accumulating units for accumulating said paper sheet matters on the basis of the result of reading by said reading means, second accumulating means disposed above and adjacent to said first accumulating means and having a plurality of accumulating units for accumulating said paper sheet matters on the basis of the result of reading by said reading means, and conveying means by which the paper sheet matters subjected to the reading of the sorting information by said reading means are conveyed to said first accumulating means or said second accumulating means, wherein said first accumulating means and said second accumulating means accumulate said paper sheet matters in an approximately standing posture, wherein each of said first accumulating means and said second accumulating means includes a reject accumulating unit of a large capacity for accumulating paper sheet matters which are rejected, and wherein one of said reject accumulating units accumulates only paper sheet matters having specified sorting information thereon.

* * * * *